US008667714B2

(12) United States Patent
Burt et al.

(10) Patent No.: US 8,667,714 B2
(45) Date of Patent: Mar. 11, 2014

(54) ATTACHMENT AND LOCKING SYSTEM FOR REPLACEABLE TRACTION CLEATS

(71) Applicant: Softspikes, LLC, Brentwood, TN (US)

(72) Inventors: John Robert Burt, Chandler, AZ (US); Lee Paul Shuttleworth, Birmingham (GB); Rand J. Krikorian, Brentwood, TN (US)

(73) Assignee: Pride Manufacturing Company, LLC, Brentwood, TN (US)

( * ) Notice: Subject to any disclaimer, the term of this patent is extended or adjusted under 35 U.S.C. 154(b) by 0 days.

(21) Appl. No.: 13/963,533

(22) Filed: Aug. 9, 2013

(65) Prior Publication Data

US 2013/0326909 A1 Dec. 12, 2013

Related U.S. Application Data

(62) Division of application No. 12/757,601, filed on Apr. 9, 2010, now Pat. No. 8,544,195.

(60) Provisional application No. 61/168,245, filed on Apr. 10, 2009.

(51) Int. Cl.
*A43C 15/02* (2006.01)

(52) U.S. Cl.
USPC ..... 36/134; 36/67 D; 36/127

(58) Field of Classification Search
USPC ..... 12/142 P, 142 R; 36/134, 67 D, 59 R, 36/67 A, 67 R
See application file for complete search history.

(56) References Cited

U.S. PATENT DOCUMENTS

| | | | |
|---|---|---|---|
| 3,731,406 | A | 5/1973 | Young |
| 4,492,047 | A | 1/1985 | Arff |
| 4,698,923 | A | 10/1987 | Arff |
| 5,036,606 | A | 8/1991 | Erich et al. |
| 5,768,809 | A | 6/1998 | Savoie |
| 6,248,278 | B1 | 6/2001 | Kelly |
| 6,272,774 | B1 | 8/2001 | Kelly |
| 6,305,104 | B1 | 10/2001 | McMullin |
| 6,631,571 | B2 | 10/2003 | McMullin |
| 6,675,505 | B2 | 1/2004 | Terashima |

(Continued)

FOREIGN PATENT DOCUMENTS

| | | | |
|---|---|---|---|
| DE | 3134817 | A1 | 10/1983 |
| DE | 34 23 363 | A1 | 1/1986 |

(Continued)

OTHER PUBLICATIONS

JP Office Action dated May 31, 2013 cited in corresponding JP 2011-508727.

(Continued)

*Primary Examiner* — Ted Kavanaugh
(74) *Attorney, Agent, or Firm* — Edell, Sharpiro & Finnan, LLC

(57) ABSTRACT

A thinner shoe mounted receptacle results from a thin cleat attachment flange received in a shallow receptacle cavity. An angled interface between the cleat and receptacle provide a friction fit engagement to minimize inadvertent disengagement of the cleat and receptacle. Rotational locking occurring inside or outside the cavity further prevents inadvertent cleat rotation. Multiple positionally synchronized angular stops positively define the final angular orientation of the cleat in the receptacle.

23 Claims, 23 Drawing Sheets

(56) References Cited

U.S. PATENT DOCUMENTS

| | | | | |
|---|---|---|---|---|
| 6,708,428 | B2 * | 3/2004 | Chen | 36/134 |
| 6,823,613 | B2 | 11/2004 | Kelly et al. | |
| 6,834,446 | B2 | 12/2004 | McMullin | |
| 7,007,413 | B2 * | 3/2006 | McMullin | 36/134 |
| 7,040,043 | B2 | 5/2006 | McMullin | |
| 7,107,708 | B2 | 9/2006 | Kelly et al. | |
| 7,137,213 | B2 * | 11/2006 | Kelly et al. | 36/134 |
| 7,370,444 | B2 | 5/2008 | Savoie | |
| RE40,460 | E | 8/2008 | Savoie | |
| 2002/0152643 | A1 * | 10/2002 | Kim | 36/127 |
| 2004/0255489 | A1 | 12/2004 | Kelly et al. | |
| 2005/0000118 | A1 | 1/2005 | McMullin | |
| 2007/0209239 | A1 * | 9/2007 | Kelly | 36/127 |

FOREIGN PATENT DOCUMENTS

| | | | |
|---|---|---|---|
| EP | 1728448 | A1 | 12/2006 |
| JP | 61135602 | A | 6/1986 |
| JP | 479642 | B2 | 12/1992 |
| JP | 2005532142 | A | 10/2005 |

OTHER PUBLICATIONS

European Search Report received in counterpart application PCT/US2010030551, dated Feb. 5, 2013.

International Search Report and Written Opinion received in PCT/US10/30551 dated Sep. 1, 2010, pp. 1-14.

* cited by examiner

ATTACHMENT AND LOCKING SYSTEM FOR REPLACEABLE TRACTION CLEATS

CROSS-REFERENCE TO RELATED APPLICATIONS

This application is a divisional of U.S. patent application Ser. No. 12/757,601, entitled "Method and Apparatus For Interconnecting Traction Cleats and Receptacles" and filed Apr. 9, 2010. The disclosure of the above-mentioned patent application is incorporated herein by reference in its entirety.

BACKGROUND

Technical Field

The present invention pertains to an improved method and apparatus for interconnecting traction cleats and cleat receptacles for athletic shoes. Although the preferred embodiments disclosed herein are used primarily in golf shoes, it is to be understood that the interconnection method and structure have application in any shoe that utilizes traction cleats that are selectively attachable to a shoe.

Terminology

It is to be understood that, unless otherwise stated or contextually evident, as used herein:

The terms "upper", "top", "lower", "bottom", "vertical", "horizontal", etc., are used for convenience to refer to the orientation of a cleat and receptacle when attached to a shoe sole resting on the ground and are not intended to otherwise limit the structures described and claimed.

The terms "axial", "axially", "longitudinal", "longitudinally", etc., refer to dimensions extending parallel to the axis about which the cleat is rotated in the receptacle and substantially perpendicular to the shoe sole.

The terms "radial", "radially", "lateral", 'laterally", etc., refer to dimensions extending perpendicularly from the cleat rotational axis and substantially parallel to the shoe sole.

The terms "angle", "angular", "rotationally", etc., unless otherwise stated refer to rotation dimension about the cleat rotational axis.

The terms "attach", "attachment", etc., pertain to a longitudinal engagement between the cleat and receptacle that prevents inadvertent axial displacement of the cleat relative to the receptacle.

The terms "lock", "locking", etc., pertain to preventing inadvertent rotational movement between the attached cleat and receptacle.

Discussion of the Prior Art

Replaceable traction cleats are designed to attach and lock into receptacles embedded in the outsole of a shoe. Typically, attachment is effected by means of a threaded stem extending from the top surface a cleat hub and engaging a correspondingly threaded socket in a shoe-mounted receptacle. The engaged thread surfaces provide the attachment by preventing longitudinal movement between the stem and socket. Examples of such an arrangement may be found in U.S. Pat. Nos. 5,036,606 (Erich), 6,272,774 (Kelly), 6,305,104 (McMullin), 6,823,613 (Kelly et al), 6,834,446 (McMullin), 7,107,708 (Kelly et al) and 7,137,213 (Kelly et al). Examples of other cleats that are useable in such arrangements may be found in U.S. Pat. Nos. 6,305,104 (McMullin), 6,675,505 (Terashima), 7,040,043 (McMullin). The entire disclosures in all of those patents are expressly incorporated herein by this reference. The receptacles used in the interconnection arrangements disclosed in the aforesaid patents necessarily have a relatively large longitudinal (i.e., vertical) profile in order to accommodate the longitudinal space needed for: (a) the threaded engagement between the receptacle and cleat stem; and (b) the locking components provided on the receptacle and cleat that gradually engage as the stem is rotated further into the socket and prevent inadvertent loosening of the interconnection between these two components. Typically, the receptacles in these arrangements have a longitudinal dimension on the order of 6 mm or greater. This dimension of the receptacle dictates a minimum thickness of the outsole of the shoe in which the receptacle is embedded. It is desirable that the receptacle be shorter in length in order to permit a thinner and less costly outsole, and because many golfers desire a thinner outsole to improve their feel for the terrain.

In order to prevent inadvertent rotation of the cleat stem relative to the socket, it is known to provide a locking arrangement such as that disclosed in the Kelly '774, Kelly, '613, Kelly et al '708 (Kelly et al) and Kelly et al '213 patents. These locking arrangements typically include teeth projecting radially from the socket exterior on the receptacle which increasingly engage, as a function of axial insertion of the stem, locking posts, or the like, projecting longitudinally from the cleat hub in spaced relation to the threaded stem.

The attachment arrangement shown in U.S. Pat. Nos. 5,768,809 (Savoie), instead of attaching the cleat and receptacle by using a threaded stem to engage a correspondingly threaded socket for engagement, has a post with three radially extending retaining members at its distal end. The retaining members are received axially through retainer-matching contoured openings in a receptacle cavity end wall and rotated in the cavity to an angular position past the contoured openings in which the cavity end wall prevents longitudinal movement of the retaining members. Locking structures within the cavity and at the radial extremities of the retaining members are engaged to minimize inadvertent rotational movement of the retaining members. In order to maximize retention in the cavity, the retainer members are relatively thick in their longitudinal dimension to minimize retaining member distortion under stress. Commercial embodiments of this arrangement are sold under the Q-LOK trademark and have retaining members with a vertical thickness of approximately 3 mm at their thickest part. The receptacle cavity must be sufficiently deep to receive the retainer members, which typically requires that the overall receptacle longitudinal dimension be at least 6 mm. As noted above, this dimension of the receptacle dictates a minimum thickness of the outsole of the shoe in which the receptacle is embedded and it is desirable that the receptacle be made thinner in length in order to permit the outsole to be thinner, thereby making it less costly to manufacture and providing the golfer with a better feel for the terrain.

It has been found that reliability of the locking arrangement for the attachment structure disclosed in the aforesaid Savoie patent leaves something to be desired. Specifically, the post and retaining members are a relatively rigid unitary structure, and the outer peripheries of the retaining members are flush against the cavity periphery. As a consequence, lateral forces during use are applied directly through the cavity wall to the unitary post and retaining members, tending to jar and loosen that unitary structure, displacing it from its locking structure in the cavity and permitting it to rotate in the cavity.

In other prior art locking arrangements the rotationally locked position of the cleat relative to the receptacle may be imprecise, depending on manufacturing tolerances or inherent features of the design. It is desirable to assure that locking structures on the cleat and receptacle provide for precision and reliable locking in desired rotational orientations of cleat relative to the receptacle.

Early golf cleats attached to a receptacle in the sole of the shoe using standard screw threads on a stem and in a socket requiring as many as ten 360° revolutions to secure the cleat in the receptacle against the outsole. Attempts at locking involved compressing the top of the cleat hub against the outer surface of the outsole to effect a friction fit. However, in practical use, this friction fit did not prevent the cleat from backing itself out from over time. In addition, there was no specific stopping point which alerted the installer of the cleat that the stem had been screwed in far enough; that is, there was no "stop" and no visible, audible or tactile indication that full insertion had been achieved.

OBJECTS AND SUMMARY OF THE INVENTION

Therefore, in light of the above, and for other reasons that become apparent when the invention is fully described, it is one object of the present invention to provide improved attachment and locking methods and apparatus between a traction cleat and a shoe-mounted receptacle.

It is another object of the invention to provide an improved cleat and a receptacle therefor for use in an athletic shoe, and to provide an athletic shoe employing said combination.

A further object of the invention is to provide an improved traction cleat for an athletic shoe.

A still further object of the invention is to provide an improved receptacle adapted to be mounted in an athletic shoe to receive a traction cleat.

Another object of the invention is to provide, in combination, an athletic shoe in combination with an improved receptacle for receiving a traction element.

It is also an object of the invention to provide an attachment arrangement between a cleat and receptacle that is configured to permit minimization of the longitudinal profiles of the cleat and the receptacle, individually and in combination.

Another object of the invention is to provide locking arrangements between a cleat and receptacle configured to permit minimization of the longitudinal profiles of cleat and the receptacle, individually and in combination.

It is another object of the present invention to provide attachment and locking apparatus and methods between a traction cleat and a receptacle wherein the receptacle longitudinal dimension can be minimized.

It is another object of the present invention is to provide plural positionally synchronized locking apparatus and methods between a cleat and receptacle to assure positive locking in a predetermined rotational position of the cleat.

A further object of the invention is to provide locking apparatus and methods between a cleat and receptacle that provide a cleat installer with positive humanly perceptible feedback upon insertion of the cleat to the desired position in the receptacle.

The aforesaid objects are achieved individually and in combination, and it is not intended that the present invention be construed as requiring two or more of the objects to be combined unless expressly required by the claims attached hereto.

With the foregoing objects in mind, in accordance with one aspect of the invention a receptacle is provided having a total height of 5 mm or less and preferably approximately 3 or 4 mm. In one embodiment of the invention an attachment structure for a traction cleat includes a connection stem projecting upwardly from a cleat hub concentrically about the cleat attachment axis and first and second 180°-spaced relatively thin attachment flanges extending radially from the distal end of the stem. A receptacle cavity or socket is defined concentrically about a receptacle attachment axis by a hollow generally cylindrical boss projecting downwardly from a base with a distal end wall having apertures contoured to permit passage of the cleat attachment flanges when the cleat stem is inserted into the cavity in an insertion angular orientation with the cleat and receptacle attachment axes in coaxial orientation. The bottom surface of each attachment flange and a respective section of the interior surface of the distal end wall of the boss are correspondingly arcuately sloped or ramped about the attachment axes such that, in response to rotation of the flanges in the cavity about the attachment axes, an increasingly tighter friction or interference fit is created between the flange and the proximal and distal end walls of the cavity. As the rotation continues each flange contacts a respective rotational stop member in the cavity defining a final angular or rotational orientation of the cleat relative to the receptacle, in which position the cleat is locked in the receptacle in the manner described herein. The interference fit between the flange and cavity end walls opposes inadvertent rotation of the flange and thereby provides a first locking function for the cleat in the receptacle.

Additional locking is effected radially outward from the receptacle cavity. Specifically, two cleat locking structures, angularly spaced by 180°, also project upwardly from the cleat hub at locations radially spaced from the stem and angularly interleaved between the attachment flanges. The radially inward facing surface of each cleat locking structure has three angularly successive convex ridges separated by two concave recesses. The ridges and recess extend axially the entire vertical height or length of the cleat locking structure. Two receptacle locking clusters, also angularly spaced by 180°, are extend circumferentially on the outer wall of the cylindrical boss angularly interleaved between the contoured openings in the distal end wall. The radially outward facing surface of each receptacle locking cluster has three angularly successive concave recesses bounded by four locking teeth. These teeth and recesses extend axially the entire vertical height or length of the outer surface of the receptacle boss. The locking structures and locking clusters are sized and oriented such that the ridges of the each cleat locking structure radially interferes with the teeth of a corresponding receptacle locking cluster when those ridges and teeth are angularly aligned. Similarly, when the ridges or teeth of a locking structure or cluster are angularly aligned with recesses of the corresponding locking cluster or structure, the ridges or teeth extend into the aligned recesses such that inadvertent rotation of the cleat is resisted by the adjacent interfering ridges or teeth.

The top surface of each cleat locking structure slopes downward toward the hub as a function of angular position to define an upwardly facing arcuate ramp surface that curves about the attachment axes. As the cleat stem is rotated in the receptacle socket during cleat installation, the ramp segments on the top sections of the cleat locking structures are gradually compressed against arcuate surface sections of the receptacle to effect a force fit tightening of the cleat in the receptacle.

The top surface of the cleat hub is provided with two shallow upwardly extending helical ramp segments spaced from one another by 180° and disposed coaxially about the cleat stem in the arcuate space between the stem and a respective cleat locking structure. The bottom surface of the boss end wall on the receptacle has two corresponding shallow downwardly extending helical ramp segments spaced by 180° and disposed coaxially about the receptacle axis at angular locations between the receptacle locking structures. The radial locations of the ramps on the cleat has them aligned with respective ramps on the receptacle such that as the cleat stem is rotated in the receptacle cavity the aligned arcuate ramps slide along one another in an angled interface that provides a gradually increasing friction or interference engagement. The ramps each terminate in respective radially extending shoulders positioned such that they angularly abut and serve as additional positive rotational stops in the final angular position of the cleat stem relative to the receptacle socket.

In the present invention the cleat stem is fully axially inserted in the receptacle cavity prior to its rotation therein, unlike threaded engagements wherein gradual axial insertion is effected by rotation. As the stem and flange are rotated in the cavity, the entire axial length of successive ridges on each cleat locking structure are angularly forced past the entire axial length of successive teeth of the receptacle locking cluster in steps, first one ridge at a time, then two and finally three, at which point the cleat is in the final angular position in the receptacle with the ridges and teeth of each locking structure/cluster residing in recesses of the facing locking cluster/structure. With each step the installer receives both tactile and audible "click" indications. In addition, since more ridges and teeth are engaged during each step, the rotational force required for that step is greater. As a consequence, the installer is made readily aware when a cleat is partially or fully inserted. Since there are two pairs of engaged locking structures and clusters, six ridges and teeth are engaged in the final angular position to provide strong positive rotational locking.

Instead of facing one another radially, the ridge/teeth and recesses may be arranged to face and engage one another in the vertical or axial dimension as described in detail hereinbelow.

Although the preferred embodiment utilizes two attachment flanges disposed in angular symmetry on the cleat stem, it is to be understood that only one flange or three or more flanges may also be used as described herein.

The attachment flanges are described as being "thin" in the vertical dimension. By "thin" it is meant that the tapered flange at its thickest portion has a vertical dimension on the order of 1.5 mm or less. The resistance to flexure lost by making the flange that thin is more than compensated for by the additional locking arrangements described herein, and by the small annular spaces between the stem and cleat locking structures that absorb lateral impact instead of the impact being applied directly to the receptacle boss. A primary benefit of the thin flange is the ability to reduce the vertical dimension of the receptacle.

The features described in combination above may also be used independently. For example, the cleat locking structures and receptacle locking clusters may be used with any type of attachment arrangement including a threaded stem and socket. Likewise, the interference fit provided by the mutually engaged helical ramps on the cleat and receptacle may be used with a threaded stem and threaded socket.

The above and still further features and advantages of the present invention will become apparent upon consideration of the definitions, descriptions and descriptive figures of specific embodiments thereof set forth herein. In the detailed description below, like reference numerals in the various figures are utilized to designate like components and elements, and like terms are used to refer to similar or corresponding elements in the several embodiments. While these descriptions go into specific details of the invention, it should be understood that variations may and do exist and would be apparent to those skilled in the art in view of the following description.

DESCRIPTION OF THE PREFERRED EMBODIMENTS

Figure 1:
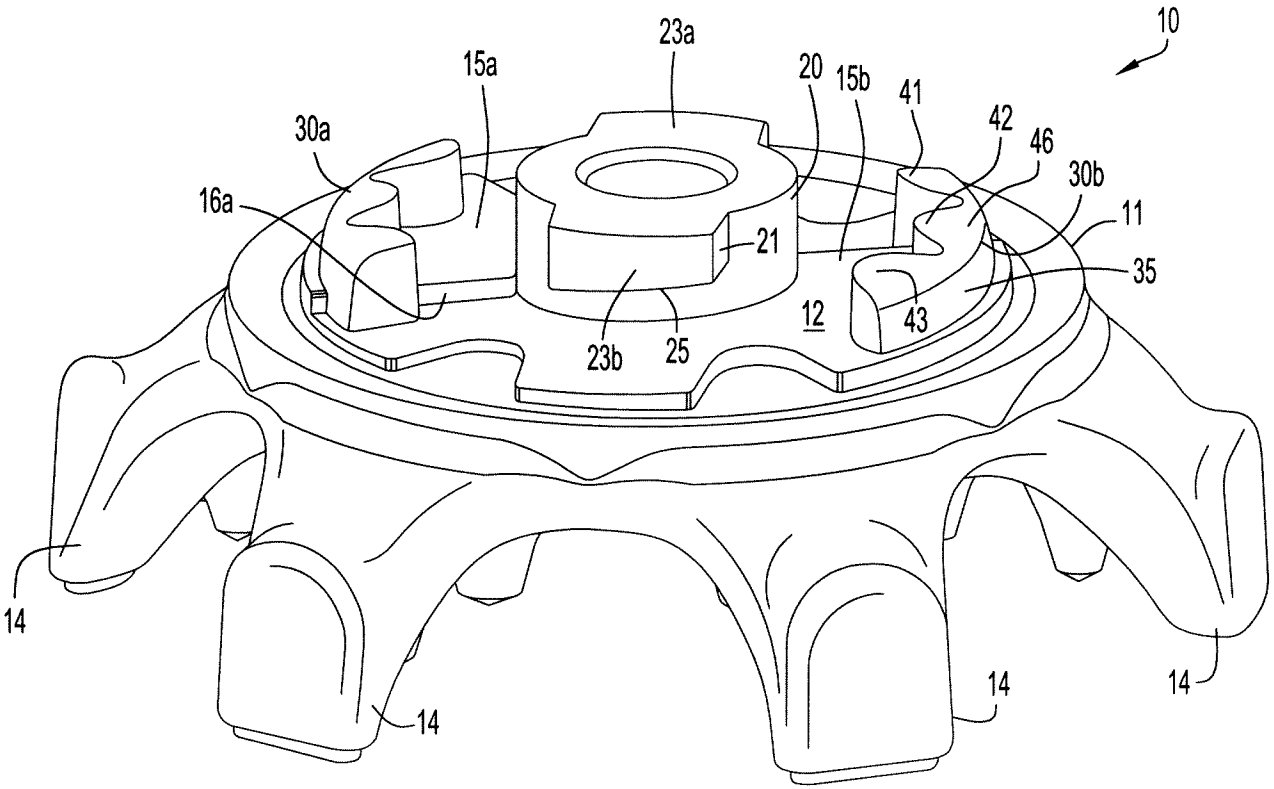
FIG. 1 is a view in perspective from above of a cleat according to a first embodiment of the present invention.

The specific angular and linear dimensions set forth below are by way of example for particular embodiments to assist in an understanding of the illustrated structure; these dimensions are not to be construed as limiting the scope of the invention.

Referring specifically to FIGS. 1-11 and the embodiments disclosed therein, a traction cleat 10 comprises a hub 11 with a top surface 12 and bottom surface 13. The hub is generally circular but can be otherwise configured, symmetrically or asymmetrically about cleat attachment axis A. Ground engaging traction elements 14 extend generally downward from the hub periphery or bottom surface. It is to be understood that particular traction elements do not form part of the present invention and may be provided as static or dynamic elements in any number, array or orientation. In the particular embodiment illustrated in FIGS. 1-5 there are six traction elements 14 spaced at equal angles in an array that is symmetrical about cleat axis A.

A generally cylindrical connection stem 20 may be integrally molded with hub 11 and includes a proximal end and a distal end. Stem 20 projects upwardly from top surface 12 concentrically about cleat attachment axis A. Two vertically thin attachment flanges 23*a*, 23*b* extend generally radially outward from 180°-spaced locations at the distal end of stem 20. Each flange has a flat leading edge 21 oriented substantially parallel to axis A and angularly facing in the direction of cleat rotation about that axis during cleat insertion into a receptacle. The top surface of each flange 23*a*, 23*b* is coplanar with the distal end of stem 20. The bottom surface 25 of each flange diverges downwardly and angularly rearward from leading edge 21 to define a flange ramp surface having a curvature about axis A. A vertical space is defined between flange bottom surface 25 and the top surface 12 of cleat hub 11, such space becoming vertically narrower in an angular direction as a result of the divergence of flange surface 25. The rearward edge of each flange is preferably flat and parallel to axis A. The flange sides are flat and converge slightly at a small angle, typically 5° to 7°. The radially outer edge of each flange is preferably arcuate. The proximal end of each flange at the periphery of stem 20 subtends an angle at the stem of approximately 80°. In the illustrated embodiment, the vertical thickness of the flange at its thickest portion is approximately 1.5 mm.

There are two locking structures 30*a*, 30*b*, spaced by 180° (on center) and standing upwardly from the top surface 12 of hub 11 proximate the hub periphery. Each locking structure includes a substantially smooth and arcuate radially outward facing surface 35, a leading end 36, a trailing end 37 and an undulating radially inward facing surface which serves to provide a cleat locking function. Leading end 36 is a substantially planar (i.e., flat) radially and vertically extending surface facing angularly in the direction of rotation during cleat insertion. Trailing end 37 is arcuate and forms part of a ridge as described below. Each locking structure extends about axis A through an angle on the order of 74°.

Figure 2:
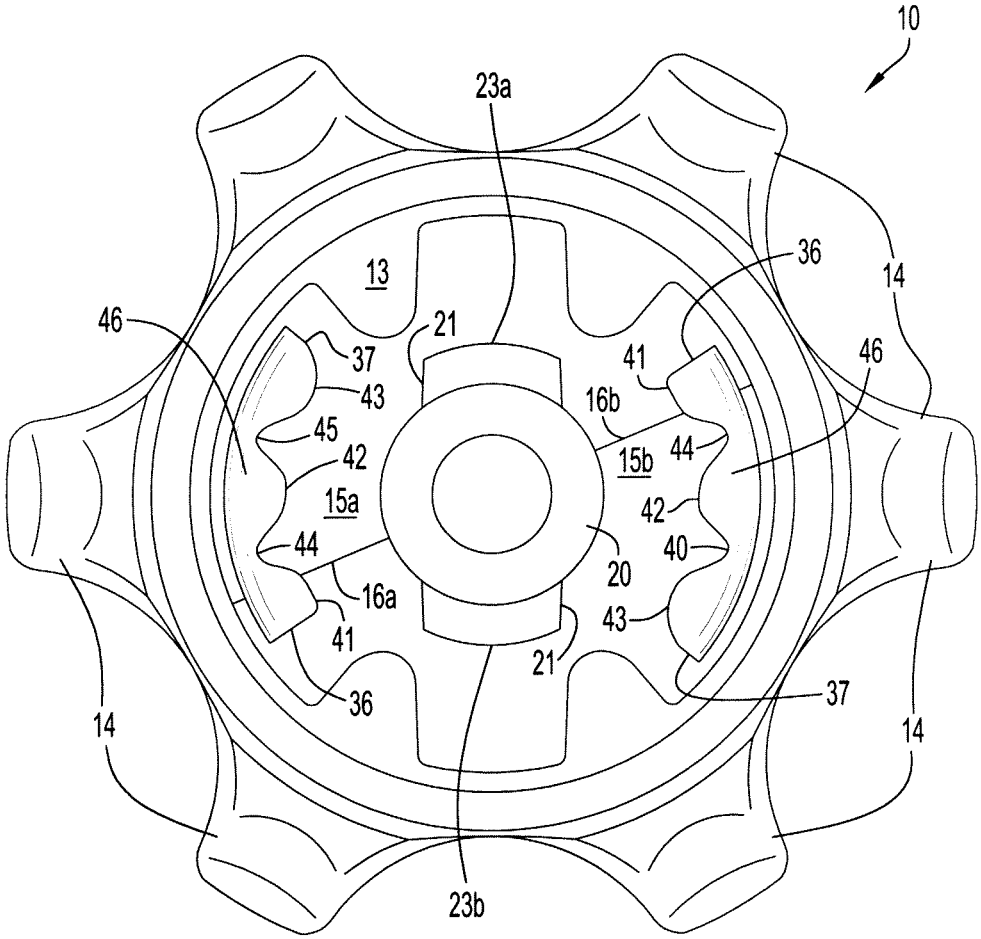
FIG. 2 is a top view in plan of the cleat of FIG. 1.
Figure 3:
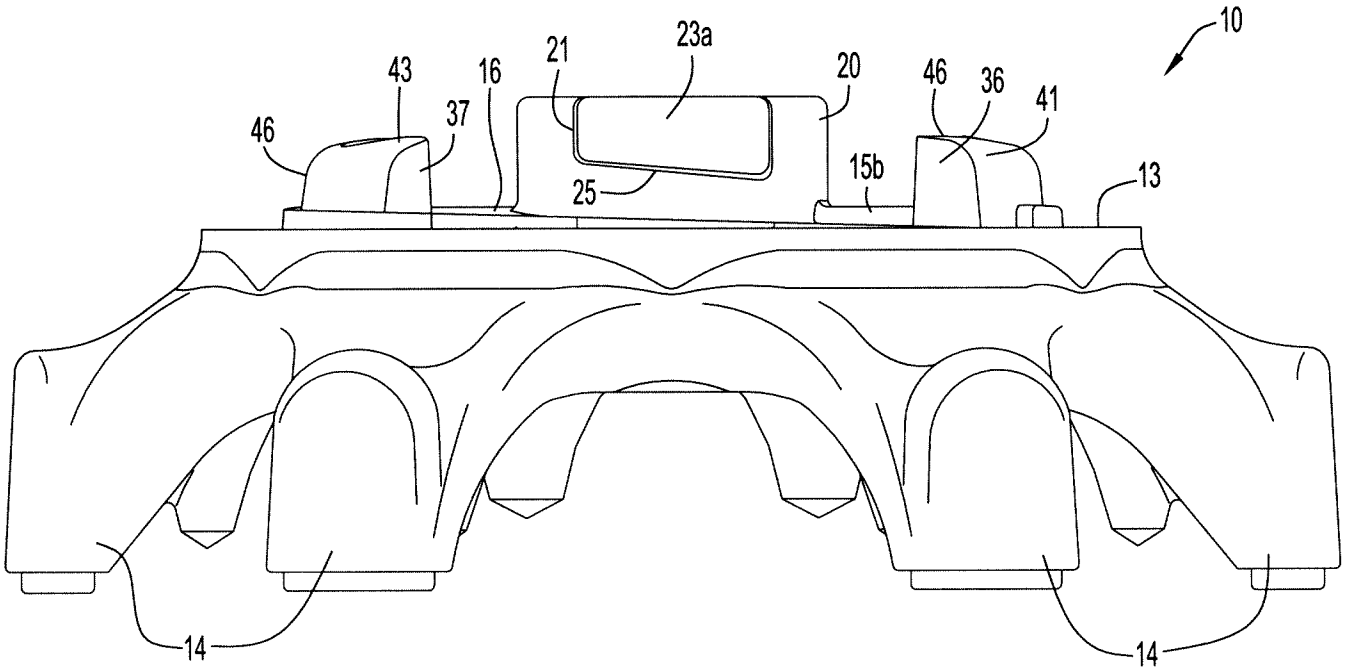
FIG. 3 is a front view in elevation of the cleat of FIG. 1.
Figure 4:
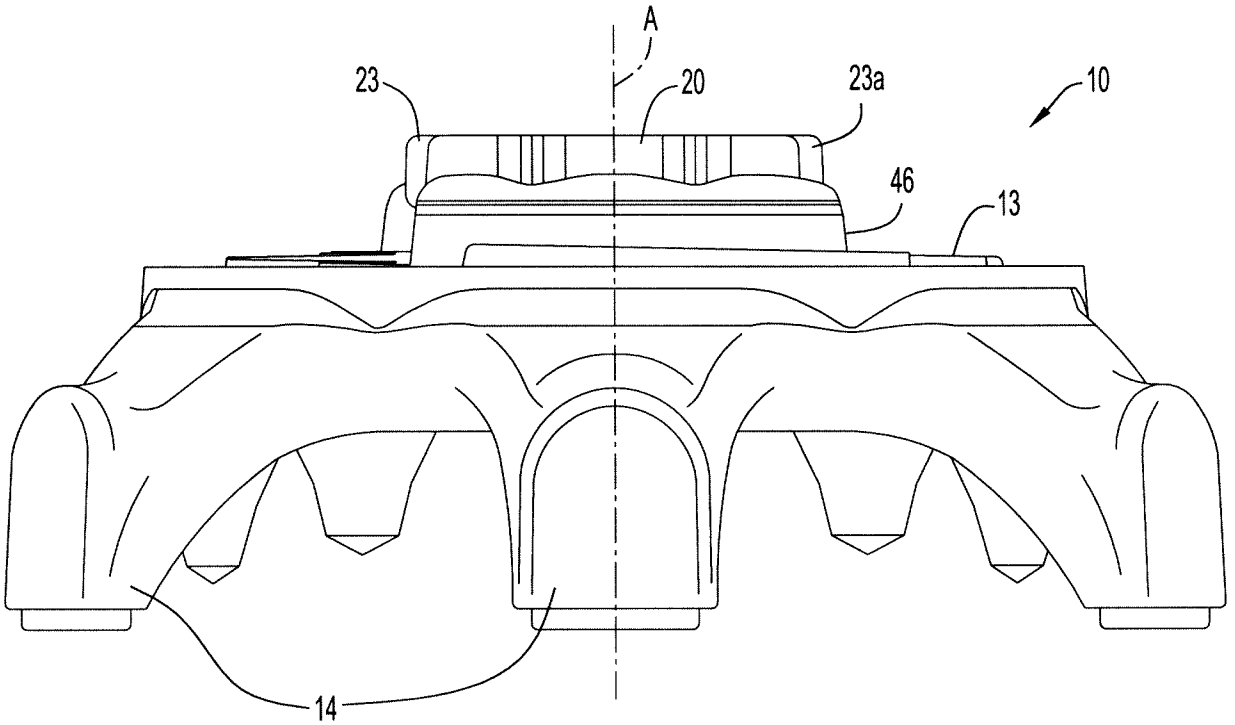
FIG. 4 is a side view in elevation of the cleat of FIG. 1.

The inward facing surface of each locking structure includes an angularly extending series of three convex ridges 41, 42, 43 projecting radially inward toward axis A and separated by concave recesses 44 and 45 disposed between ridge pairs 41, 42 and 42, 43, respectively. The ridges and recesses extend lengthwise the entire height of structures 30*a*, 30*b*. The angular contour of the series of the ridges and recesses is continuous and smooth to provide locking ramp surfaces having slopes appropriate to the locking functions. The apex of each ridge 41, 42, 43 is preferably rounded with a larger radius of curvature than the radius of curvature of the nadir of recesses 44, 45. As best illustrated in FIG. 2 wherein leading edge 36 is at the counterclockwise end of structures 30*a*, 30*b*, the leading ramp of ridge 42 extending from the nadir of recess 44 has a shallower slope than the trailing ramp of ridge 41 extending from the nadir of recess 44. Likewise, the leading ramp of ridge 42 extending from the nadir of recess 44 has a shallower slope than the trailing edge of ridge 41 extending from the nadir of recess 44. In the illustrated embodiment, relative to a radial line between axis A and the nadir of each recess, the leading ramp of each ridge subtends an angle of approximately 30° and the trailing ramp subtends an angle of approximately 40°. The apex of each ridge extends sufficiently far inward to contact locking structure teeth on the receptacle described below during insertion of the cleat in that receptacle. In this regard, the locking structure must be made of a material that permits it to resiliently flex or distort radially outward somewhat to permit ridges 41, 42, 43 to be forced angularly past the interfering receptacle teeth during cleat insertion into the receptacle.

The top surface 46 of each locking structure slopes downward toward the hub top surface 12 as a function of angular position from leading edge 36 to trailing edge 37. As a result, leading ridge 41 is axially longer (i.e., taller) than middle ridge 42 which, in turn, is axially longer than trailing ridge 43. Top surface 46 serves as a shallow ramp surface which engages a surface on the receptacle described below.

The top surface of the cleat hub is also provided with two shallow upwardly extending helical ramp segments 15*a*, 15*b* spaced from one another by 180° and disposed coaxially about axis A in the arcuate space between the stem 20 and a respective cleat locking structure 30*a*, 30*b*. The height of the ramp segments increases as a function of angular displacement about axis A in the direction of cleat insertion rotation, and each ramp segment extends angularly approximately 90°. The raised terminal edges of the ramp segments 15*a*, 15*b*, respectively, define radially extending shoulders 16*a*, 16*b* serving as rotational stops. These stops are positioned to abut corresponding rotational stop structure on the receptacle, described below, in the final angular insertion position of the cleat. In this regard, the leading edges of flanges 21, leading ends 36 of the locking structure 30*a*, 30*b*, and stops 16*a*, 16*b* are angularly synchronized positionally to contact respective rotation stop structures on the receptacle.

A receptacle configured to receive cleat 10 in accordance with the principles of the present invention is illustrated in FIGS. 6-11 to which specific reference is now made. Receptacle 50 includes a base 51 having a bottom surface 53 and a top surface 52. The base is generally circular but can be otherwise configured, symmetrically or asymmetrically about receptacle attachment axis B. When cleat 10 is installed in receptacle 50, cleat axis A and receptacle axis B are coaxially positioned. An outer ring portion of base 51 has a plurality of mounting slots defined longitudinally therethrough for securing the receptacle in a shoe sole. Mounting of the receptacle is effected by methods well known in the art and may include forming the outsole material around the mounting slots, or compression molding as disclosed in U.S. Pat. No. 6,248,278 (Kelly), etc. A generally cylindrical hollow boss 54 is provided centrally on the base and defines a hollow generally cylindrical interior or cavity 55 disposed concentrically about the receptacle longitudinal axis B. The distal end wall 56 of the boss has a contoured aperture 57 defined therethrough to provide access to the cavity. Aperture 57 is contoured to receive, and preferably match, the contour of the distal end of cleat stem 20 and its two attachment flanges 23*a*, 23*b*. Specifically, aperture 57 has a central portion configured to receive stem 20 from which two radially extending flange-receiving sections project. The longitudinal depth of cavity 55 is slightly greater than the maximum longitudinal thickness of the cleat attachment flanges 23*a*, 23*b* so that the entire thickness of the flanges can be received within the cavity. Two shoulder stops 65 extend radially inward from the cavity periphery, and longitudinally across the depth of the cavity, to serve as rotational stops for the received flanges during cleat installation. Shoulders 65 are mutually spaced by 180° and each limits the rotation of a respective attachment flange 20 in the cavity to approximately 90° after the flanges have been axially inserted into the cavity through the flange-receiving segments of aperture 57. The angular positions of shoulders 65 are positionally synchronized with other rotational stops described herein to define the final angular position of the cleat relative to the receptacle.

The interior (i.e., upward-facing) surface 66 of each of the two arcuate sections of the boss distal end wall 56, angularly located between flange-receiving sections of aperture 57, slopes upwardly in the direction of forward rotation of the flanges during installation. The result is an angular narrowing of the longitudinal depth of the cavity 55 in the installation rotation direction. This narrowing substantially matches the divergence of the undersurface 25 on the attachment flange to provide for a gradually increasing compression of the flange between the boss end walls as a function of the installation rotation angle. Specifically, when surface 66 and undersurface 25 make initial contact during installation rotation, the contact is relatively loose, but as rotation continues the contact becomes gradually tighter and the flanges become more tightly compressed in an axial dimension between the cavity end walls. The result is pulling of the cleat into close engagement with the receptacle, and an interference or friction fit between surface 66 and undersurface 26 that acts in concert with other locking features described herein to prevent inadvertent rotation of the installed cleat.

The exposed (i.e., downwardly-facing) surface of boss end wall 56 has two shallow depending helical ramp segments 60*a*, 60*b* spaced from one another by 180° and disposed coaxially about axis B. The longitudinal height of ramp segments 60*a*, 60*b* increases as a function of angular displacement about axis B in the direction of cleat insertion rotation, and each ramp segment has an angular length of between 90° and 180° about the axis. The depending terminal edges of ramp segments 60*a*, 60*b*, respectively, define radially extending shoulders 61*a*, 61*b* or rotational stops. Ramp segments 60*a*, 60*b*, are positioned to be radially aligned with ramp segments 15*a*, 15*b*, respectively, of cleat 10 in an angled interface during cleat insertion. In particular, upon axial insertion of attachment flanges 20 through receptacle aperture 57, prior to rotation (i.e., in the insertion angular orientation of the cleat and receptacle): the raised terminal ends of cleat ramp segments 15*a*, 15*b* are axially aligned with and abut the starting ends of respective receptacle ramp segments 60*a*, 60*b*; and the starting ends of cleat ramp segments 15*a*, 15*b* are axially aligned with and abut the depending terminal ends of receptacle ramp segments 60*a*, 60*b* in an angled interface. As stem 20 is rotated in cavity 55, the abutting ramp segments are forced into tighter axial engagement that increases with rotation angle until shoulder stops 16*a* and 16*b* engage respective shoulder stops 61*b* and 61*a*. This occurs when the cleat has reached its final angular orientation relative to the receptacle and the frictional engagement between abutting ramp segments is at a maximum.

Two angular extending receptacle locking clusters 70*a*, 70*b*, angularly spaced by 180°, extend circumferentially on the radially outer wall of the cylindrical boss angularly interleaved between the ramped surfaces 60*a*, 60*b* of the boss distal end wall. For purposes of this embodiment, the angular centers of clusters 70*a*, 70*b*, and the angular centers of the flange-receiving sections of aperture 57 preferably reside on a common diametric line extending through axis B. The radially outward facing surface of each receptacle locking cluster has three angularly successive concave recesses 71, 72, 73 bounded by four teeth 74, 75, 76, 77. These teeth and recesses extend axially the entire vertical height or length of the outer surface of the receptacle boss. The locking structures are sized and oriented such that the ridges 41, 42, 43 of each cleat locking structure radially interfere with the teeth 74, 75, 76, 77 of a corresponding receptacle locking cluster when those ridges and teeth are angularly aligned. On the other hand, when the ridges and teeth are angularly aligned with recesses of an aligned locking structure/cluster, the ridges and teeth extend into the aligned recesses such that inadvertent rotation of the cleat is resisted by the adjacent interfering ridges and teeth. In the final angular orientation of the cleat in the receptacle, teeth 75, 76 of each receptacle locking cluster reside in recesses 45, 44, respectively, of an aligned cleat locking structure.

The leading end 80 of each receptacle locking cluster is the leading edge of tooth 74 and angularly faces the direction of insertion rotation. Leading end 80 has a relatively shallow slope to facilitate it being rotationally passed by the flat radially extending leading end 36 of a cleat locking structure during cleat insertion. Another feature facilitating this passage is the sloped top surface 46 of the cleat locking structure which renders that structure axially longer at leading end 36 and permits the longer end to more readily be flexed about its root at the top surface 12 of hub 11. The leading edge 81 of trailing tooth 77 is substantially planar (i.e., flat) and extends radially to provide a rotational stop when abutted by substantially planar and flat leading end 36 of the cleat locking structure.

Angularly middle teeth 75, 76 of the receptacle locking cluster are substantially identical in configuration and taper in an outward direction to a rounded apex. Recesses 44, 45 of the cleat locking structure diverge in an inward direction that is substantially the same as the angle of divergence of receptacle teeth 75, 76 so that the teeth 75, 75 can fit closely in recesses 44, 45 in the final or locked angular orientation of cleat 10 in receptacle 50.

An axially short cylindrical wall 84 extends from the base of receptacle 50 concentrically about and outwardly spaced from boss 54 and axis B. Wall 84 and the boss 54 define between them a generally annular space 85 on the bottom surface 53 of base 51 with which the top surface 46 of each cleat locking structure 30*a*, 30*b* is radially and angularly aligned and within which those locking structures fit when stem 20 is inserted into cavity 55. Upon such insertion ramped top surfaces 46 on the cleat locking structures contact the bottom surface of receptacle base 51 in space 85 and, as the stem is rotated, top surfaces 46 are forced into tighter engagement with base 51 to provide a further friction fit engagement between the cleat and receptacle.

In attaching and locking cleat 10 to receptacle 50, stem 20 and flanges 23*a*, 23*b* are fully axially inserted through aperture 57 into receptacle cavity 55. As the stem and flanges are then rotated about axes A and B in the cavity, the entire axial length of successive ridges on each cleat locking structure 30*a*, 30*b* are angularly forced past the entire axial length of successive teeth of respective receptacle locking clusters 70*a*, 70*b* in steps: (1) cleat ridge 41 and leading end 36 are rotated past receptacle tooth 74 and into receptacle recess 71 with receptacle tooth 74 projecting into cleat recess 44; (2) then cleat ridges 41, 42 are rotated past receptacle teeth 75, 74, respectively, and into respective receptacle recesses 72, 71, with receptacle teeth 75, 74 projecting into respective cleat recesses 45, 44; (3) then cleat ridges 41, 42, 43 are rotated past receptacle teeth 76, 75, 74, respectively, and into respective recesses 73, 72, 71, with receptacle teeth 76, 75 projecting into respective cleat recesses 45, 44, and with leading end 36 of the cleat locking structure abutting leading edge 81 of receptacle trailing tooth 77 to define the final angular orientation cleat 10 in receptacle 50. With each step the installer receives both tactile and audible "click" indications provided by the ridges and teeth being forced resiliently past one another and into the next recess. In addition, since more ridges are engaged and resiliently deformed during each step, the rotational force required is greater for successive steps. As a consequence, the installer is made readily aware when a cleat is partially or fully inserted. Since there are two pairs of locking structures and clusters, six ridges and teeth are engaged in the final angular position to provide strong positive rotational locking.

In the final angular orientation of the cleat and receptacle, axial movement of the cleat relative to the receptacle is prevented by the distal end wall 56 interfering with flanges 23*a*, 23*b* which are not angularly aligned with flange-receiving openings in aperture 57.

From the foregoing it will be appreciated that there are six rotational stops, of three different types, that define the final angular orientation of the cleat and receptacle, in which orientation the cleat is locked in the receptacle by the locking structures and clusters. These stops are: (a) the two cleat shoulder stops 16*a*, 16*b* abutting respective shoulder stops 61*a*, 61*b*; (b) the leading edges 21 of cleat flanges 23*a*, 23*b* engaging respective shoulder stops 65 in cavity 55; and (c) the two leading ends 36 of the cleat locking structures engaging stops 81 of the receptacle locking clusters. The cleat and receptacle are constructed such that these stops are synchronized in angular position, meaning that all six stops become engaged at the same angular orientation of the cleat in the receptacle.

For some applications it is desirable that the cleat have a particular angular position relative to the shoe sole. For example, the shoe manufacturer may desire that a logo on the cleat have a particular orientation; or the cleat traction elements may differ from one another and specific desired tractional effects are obtained in predetermined angular positions of the cleat. The multiple stops described above predetermine a final or locking orientation of the cleat relative to the initial insertion position. In the situation It will also be appreciated from the foregoing description that there are three separate interference fit or frictional engagements provided that function in addition to the locking structures on the cleat and locking clusters on the receptacle to prevent inadvertent rotation and removal of the cleat from the receptacle. These are: (i) the frictional engagement of each flange undersurface against the interior surfaces 66 of the distal end wall 56 of the receptacle boss 54; (ii) the frictional engagement of the angled interface between cleat ramp segments 15*a*, 15*b* and receptacle ramp segments 60*a*, 60*b*; and (iii) the frictional engagement between each top surface 46 of the cleat locking structures and a respective section of the receptacle base in annular section 85 of the base bottom surface 53. The locking structure and the positive frictional engagements permit a flange of relatively small longitudinal thickness to be utilized without concern about inadvertent unlocking t and removal of the flanges from the receptacle cavity.

The angle relative to horizontal of each of the flange undersurface 25 and interior surface 66 of the boss distal end wall is typically greater than the angle relative to horizontal of the engaging ramp segments 15*a*, 15*b* and the boss end wall segments 60*a*, 60*b*. Typically, the former is on the order of 4.1° and the latter is on the order of 2.2°. As a result, as the flange is rotated in the cavity it tends to axially drive the ramp segments and end wall segments into more positive engagement to permit the interference fit between them to be more effective.

By way of example only, and not to be construed as limiting on the scope of the invention, the following are exemplary dimensions of components of the receptacle: the vertical height of receptacle 50 at its highest point between the bottom surface of the base 51 and the outer surface of distal end wall 56 is 4.0 mm; the nominal angle of the angled interface (that is ramped segments 15*a*, 15*b* and 60*a*, 60*b*) relative to horizontal is approximately 2° with a 1 mm pitch; the nominal angle of the sloped undersurface 25 of the flanges and the abutting interior surface of the boss end wall relative to horizontal is approximately 4° with a 2 mm pitch (approximately twice that angled interface angle and pitch); the angle between each apex of receptacle teeth 75, 76 and the radius drawn from axis B through the center of intermediate recess 71 is 14°; the angle between that radius and leading edge 81 of tooth 77 is 35°; the angle between that radius and the leading edge of tooth 75 is 40° (and the angle is similar for the leading edge of tooth 76); and the angle between that radius and the trailing edge of toot 75 is 30° (and the angle is similar for the trailing edge of tooth 76).

As stated above, the vertical thickness of flanges 23*a*, 23*b* of cleat 10 is approximately 1.5 mm. Accordingly, the vertical height of cavity 55 at its longest part, in order to provide the described interference fit, is approximately the same. Typically, that height would be about 1.6 mm or less.

Figure 5:
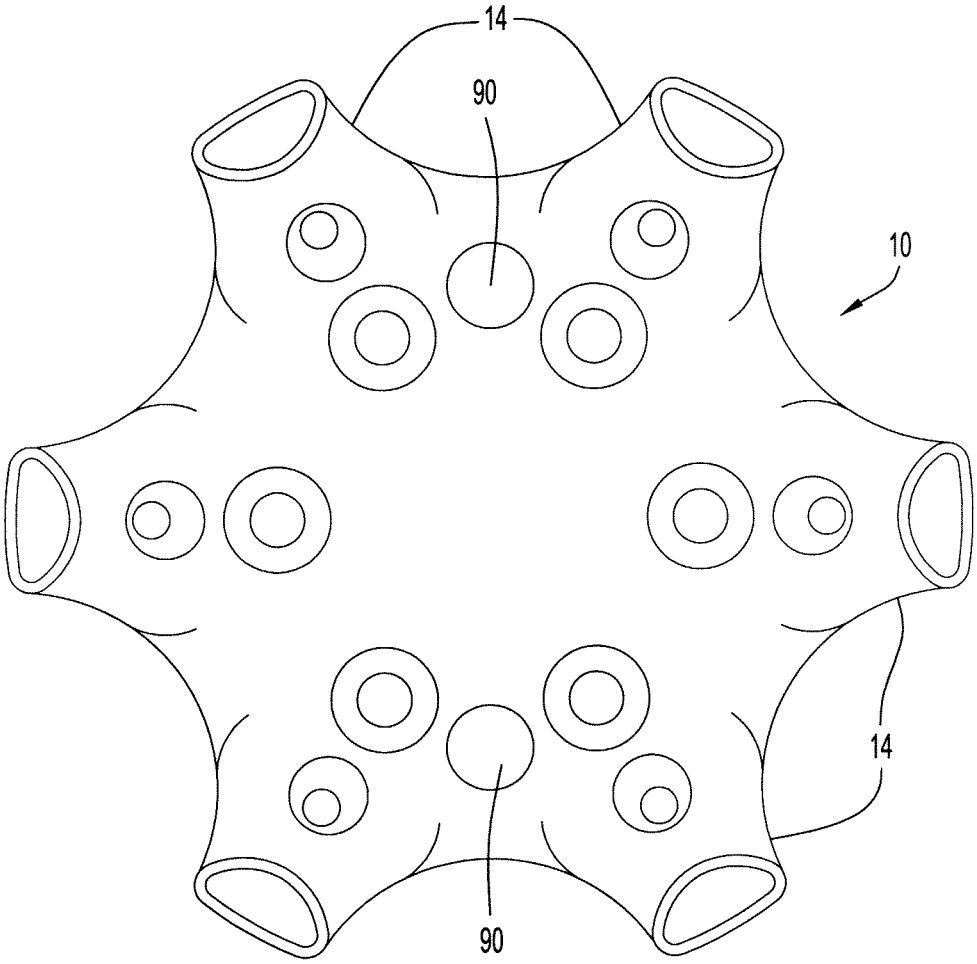
FIG. 5 is a bottom view in plan of the cleat of FIG. 1.
Figure 6:
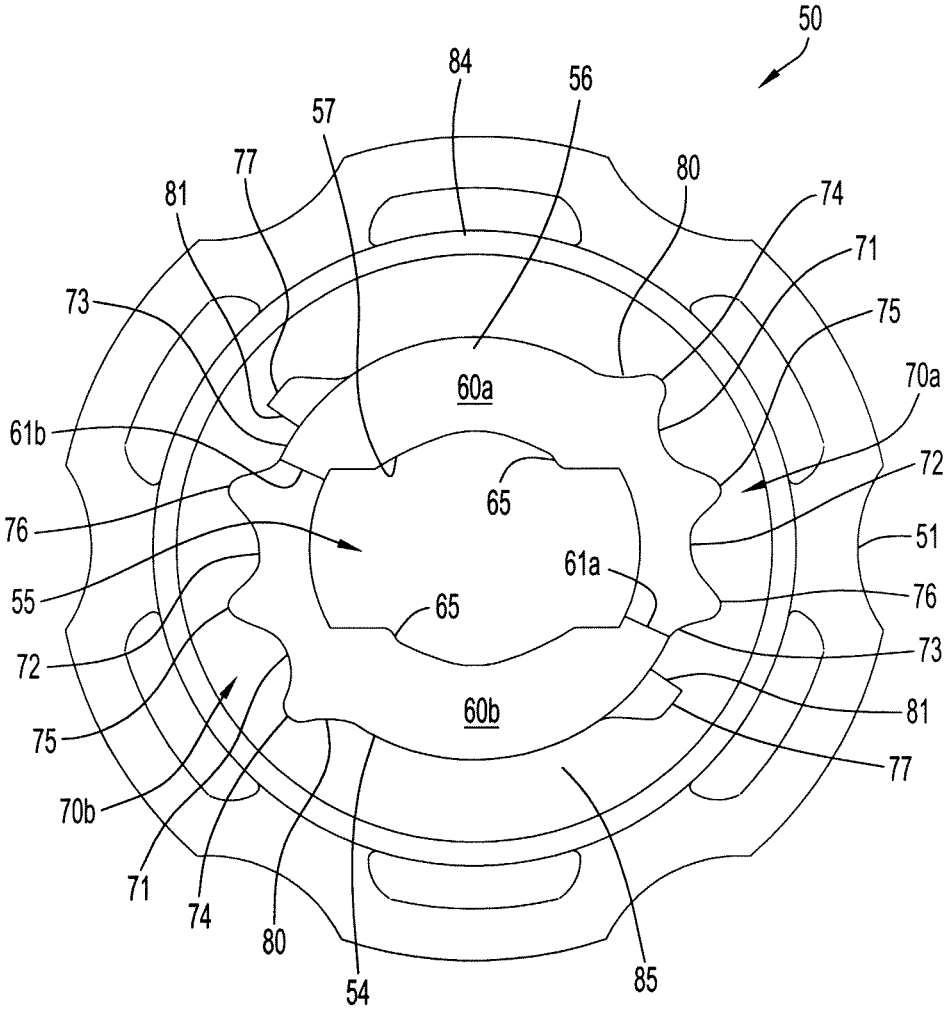
FIG. 6 is a bottom view in plan of a receptacle according to the first embodiment of the invention for receiving the cleat of FIG. 1.
Figure 7:
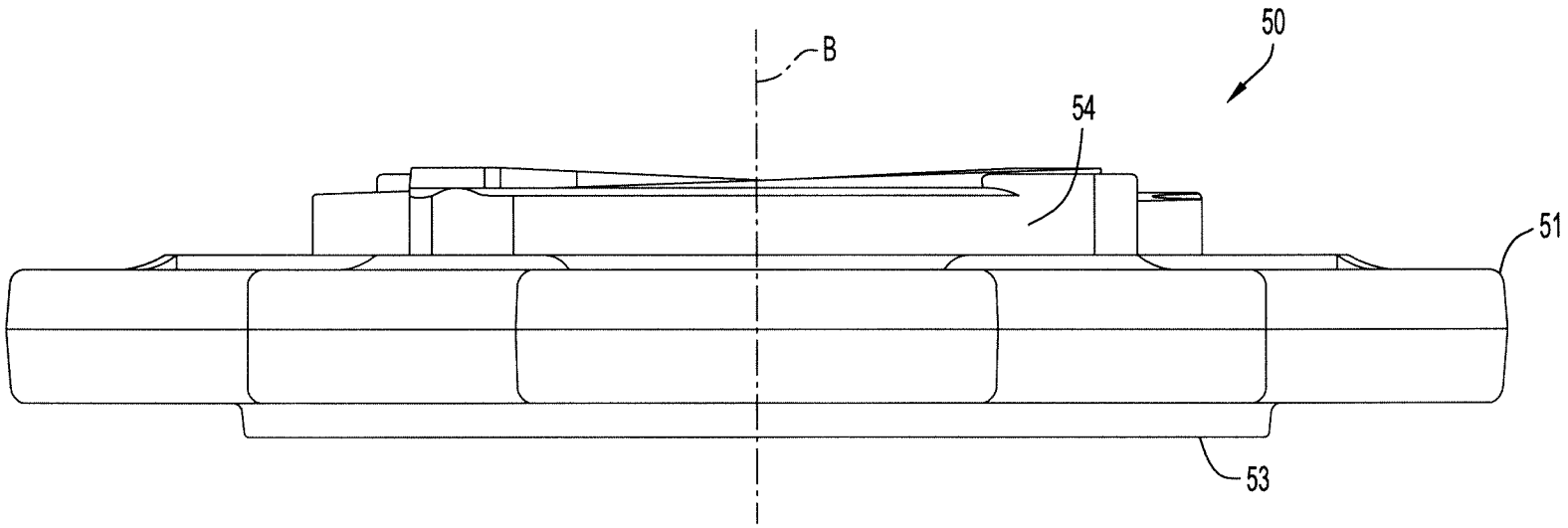
FIG. 7 is a front view in elevation of the receptacle of FIG. 6.
Figure 8:
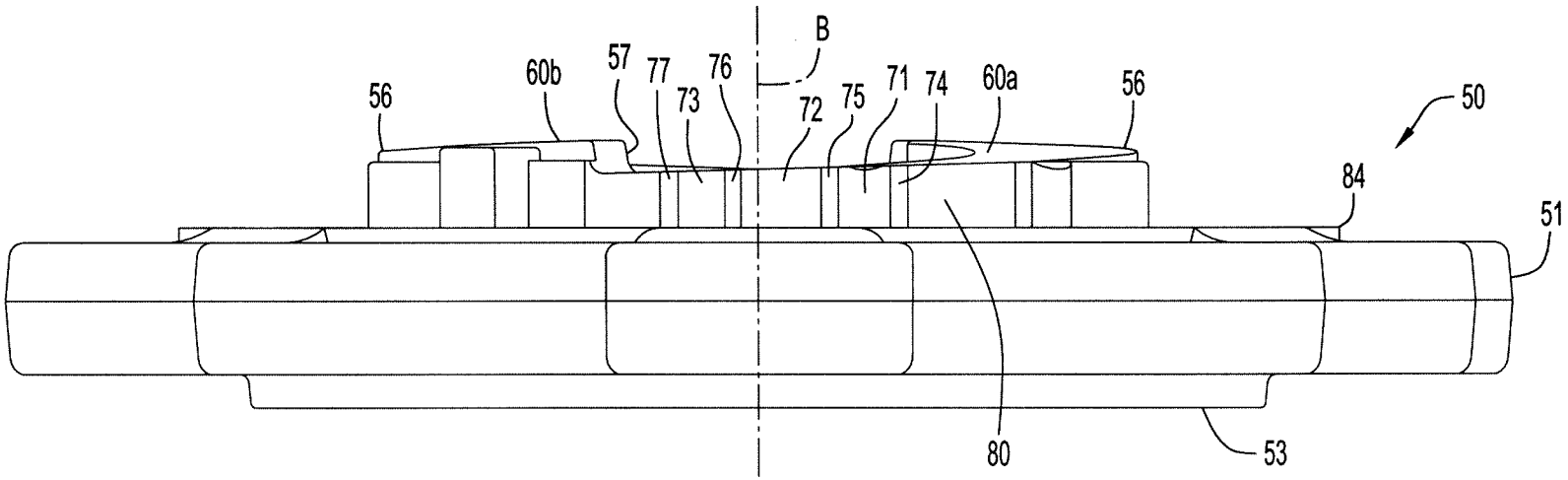
FIG. 8 is a side view in elevation of the receptacle of FIG. 6.
Figure 9:
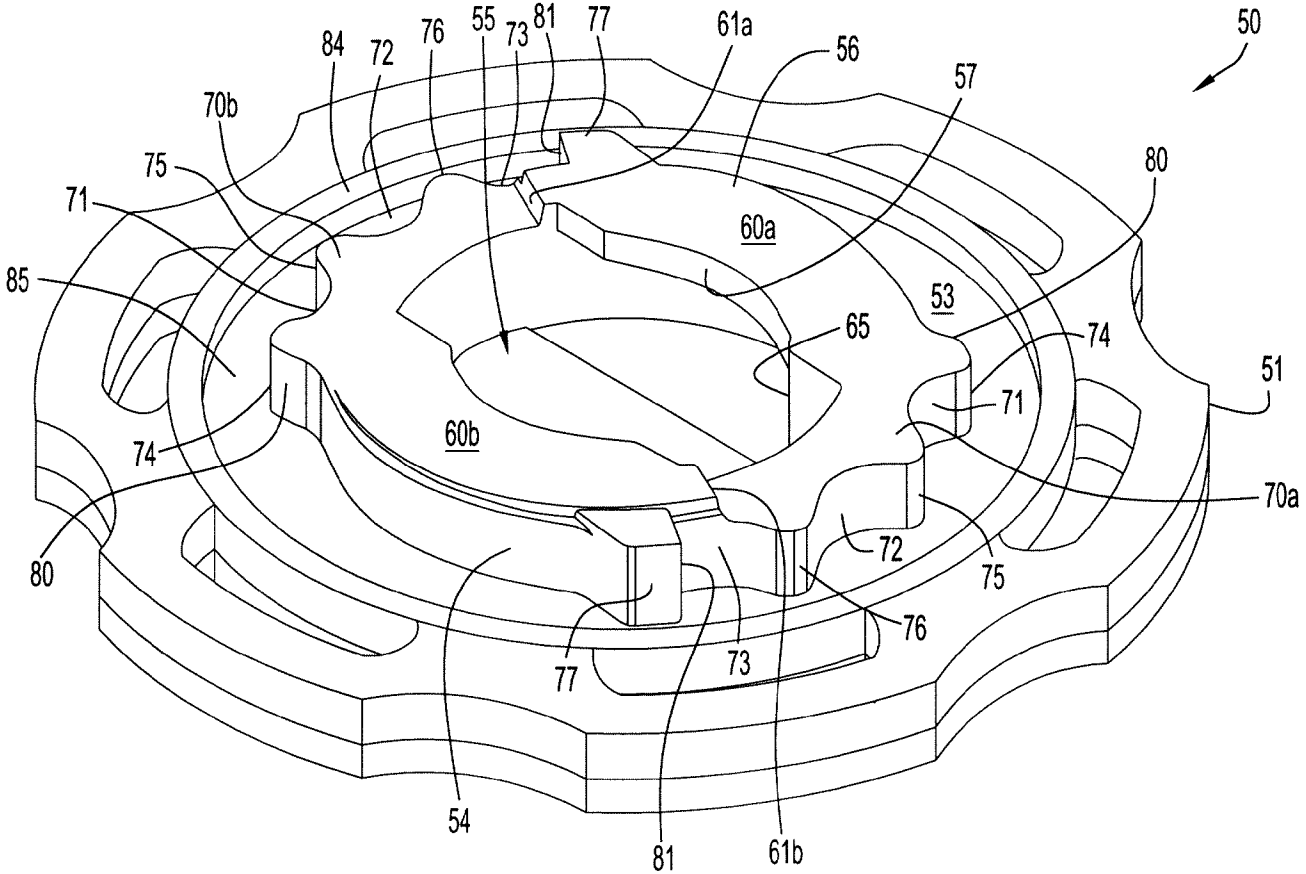
FIG. 9 is a view in perspective from below of the receptacle of FIG. 6.
Figure 10:
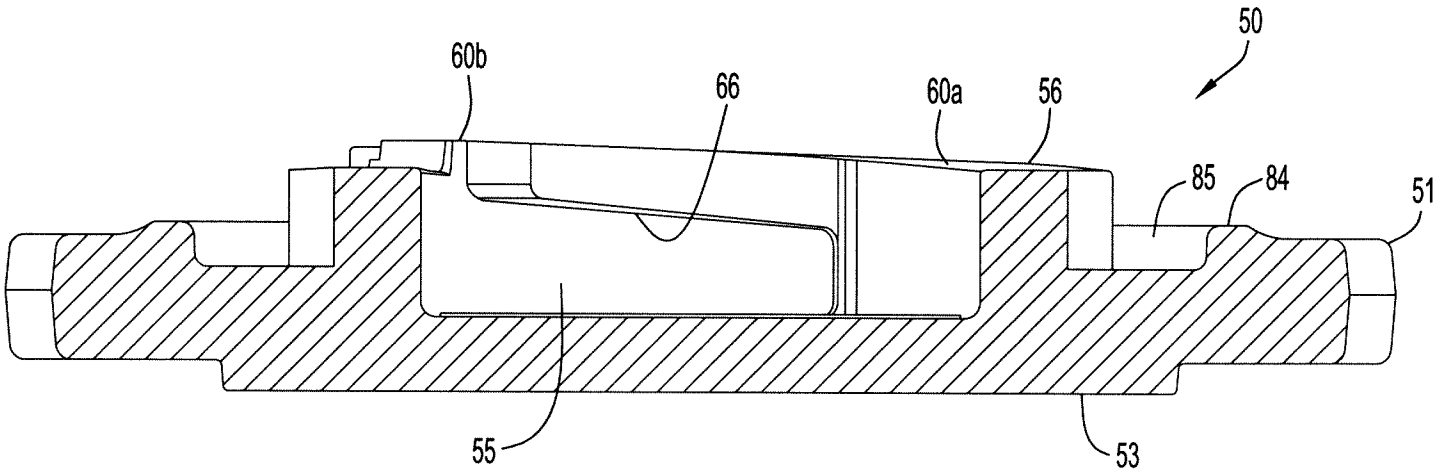
FIG. 10 is front view in section of the receptacle taken along lines 10-10 of FIG. 6.
Figure 11:
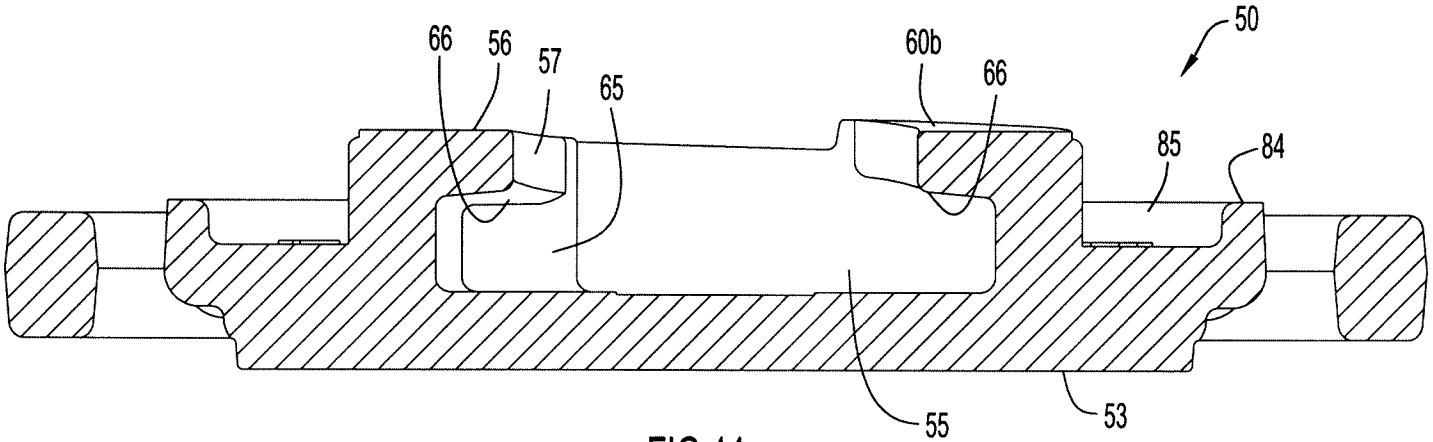
FIG. 11 is a side view in section of the receptacle taken along lines 11-11 of FIG. 6.
Figure 12:
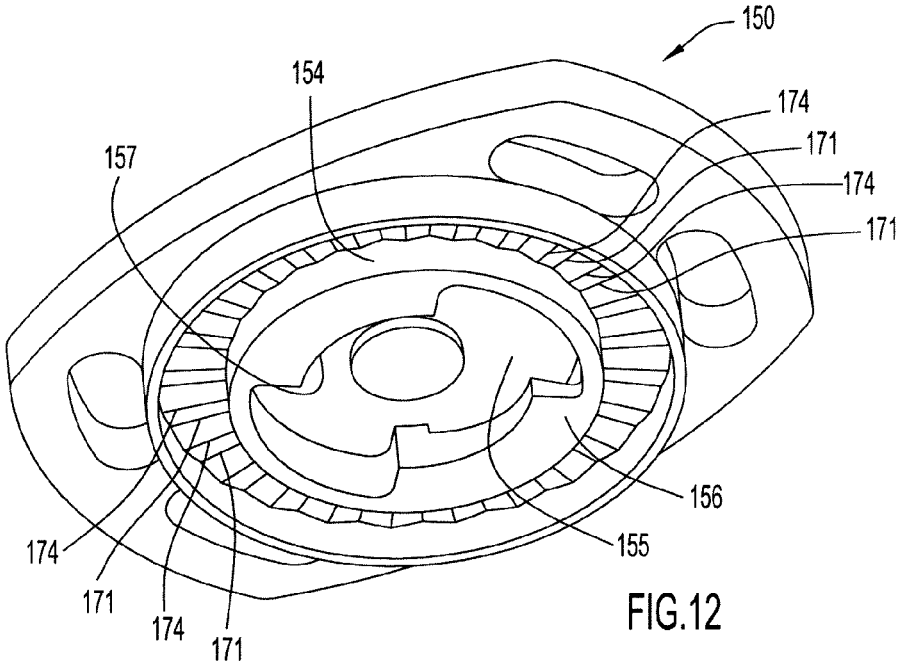
FIG. 12 is a view in perspective from below of a receptacle according to a second embodiment of the present invention.
Figure 13:
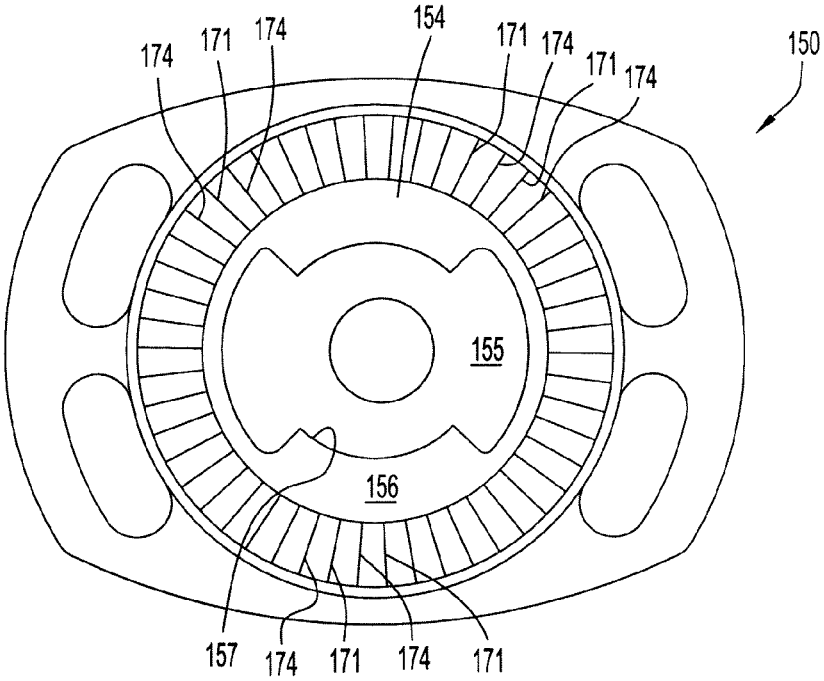
FIG. 13 is a bottom view in plan of the receptacle of FIG. 12.
Figure 14:
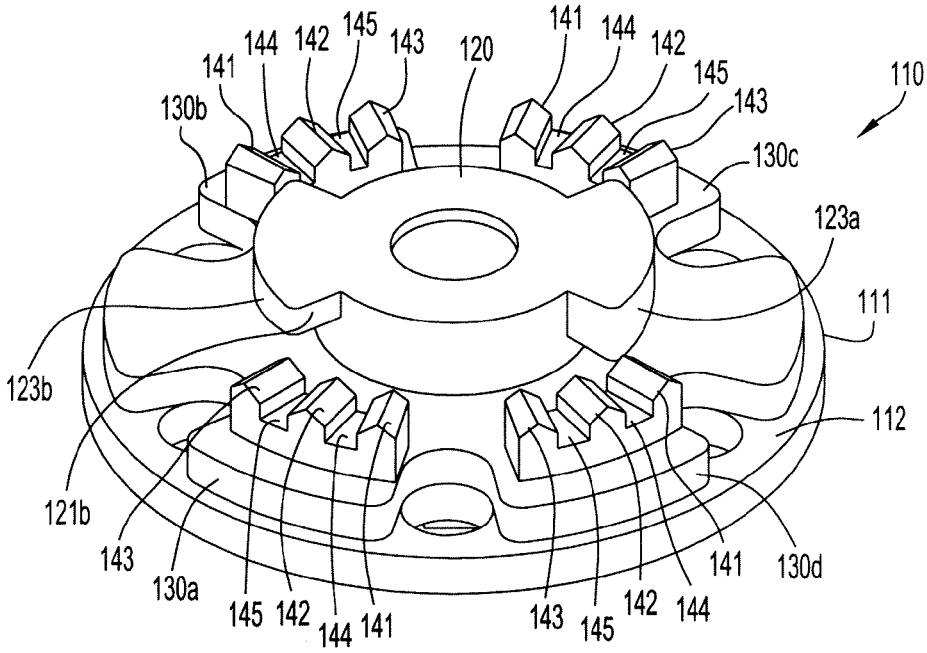
FIG. 14 is a view in perspective from above of a cleat according to the second embodiment of the invention for engaging the receptacle of FIG. 12.
Figure 15:
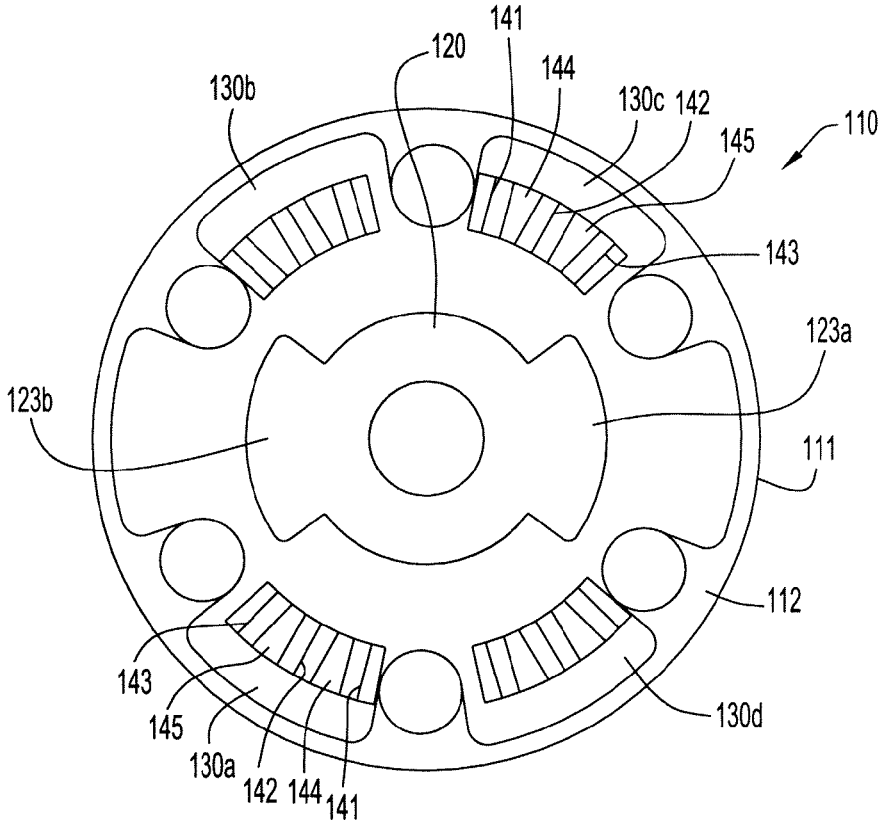
FIG. 15 is a top view in plan of the cleat of FIG. 14.
Figure 16:
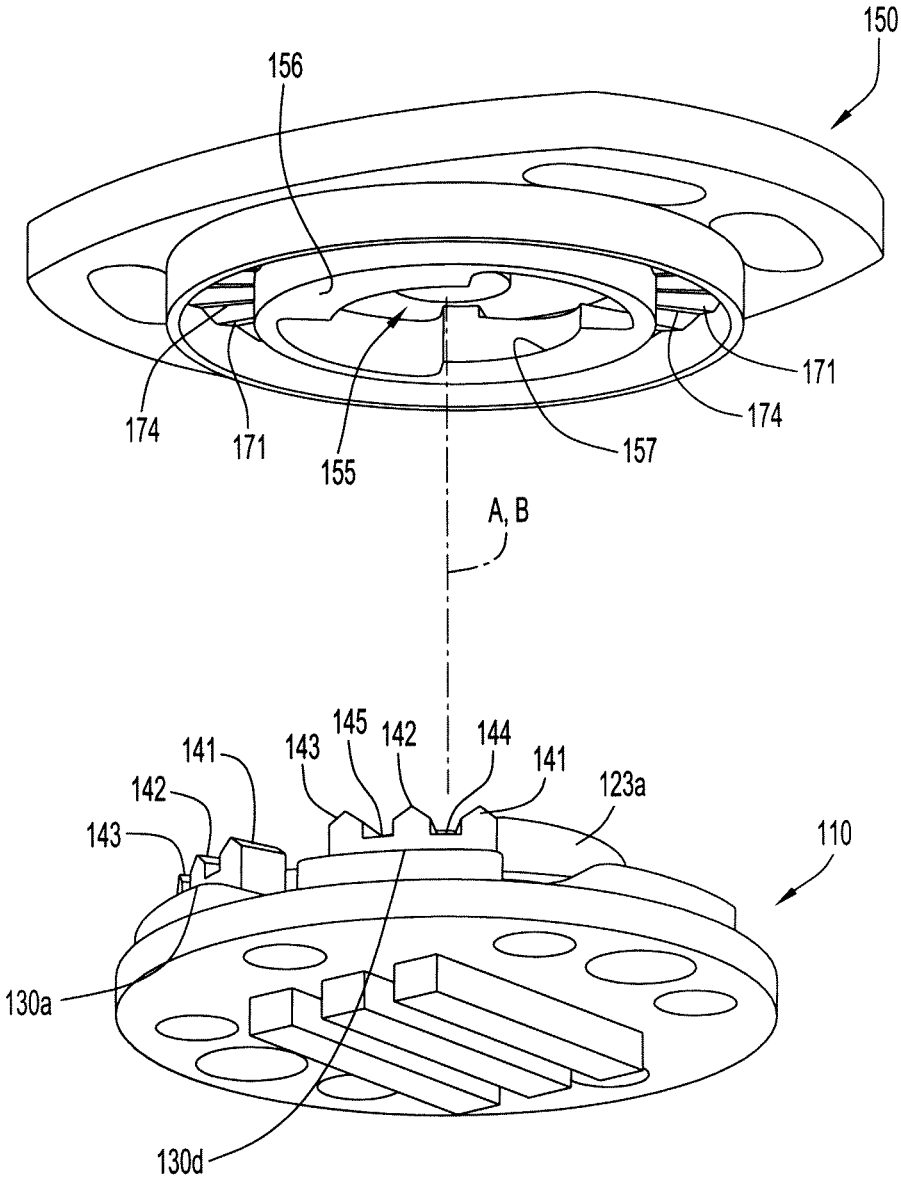
FIG. 16 is an exploded view is perspective from below of the cleat of FIG. 14 and receptacle of FIG. 12.
Figure 17:
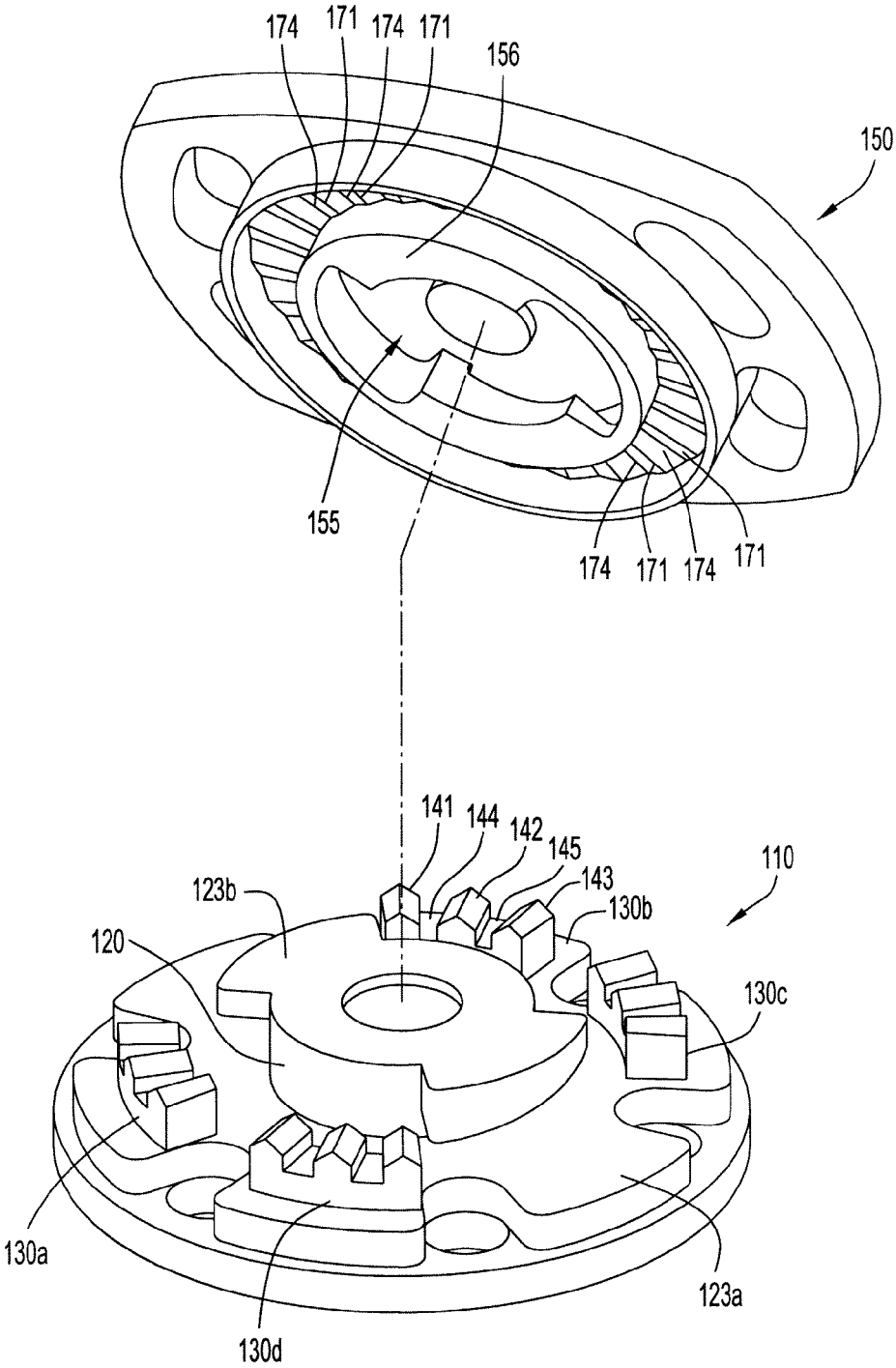
FIG. 17 is an exploded view is perspective from above of the cleat of FIG. 14 and receptacle of FIG. 12.

It will be appreciated that the differences between the leading and trailing edges of the teeth serve to make it easier to rotate the cleat in the insertion direction (typically clockwise when viewed toward the cleat bottom side) than in the removal direction (typically counterclockwise when similarly viewed. As best illustrated in FIG. 5, there are two tool access holes 90 defined in the bottom surface of the cleat at diametrically opposed locations to permit appropriate torque to be applied to the cleat by means of a conventional tool to overcome the locking force and frictional fit engagements.

In the embodiment of FIGS. 1-11 the preferred material for the receptacle is Stanyl 46 Nylon with a Durometer hardness in the range of 88 D-93 D. The preferred material for the cleat hub, stem, attachment flanges and the cleat locking structures is thermoplastic polyurethane (TPU) with a Durometer hardness of between 55 D-75 D and most preferably 71 D.

As described above, one of the several advantages of the present invention is the relatively small vertical or axial profile of the assembled cleat and receptacle, and particularly the receptacle which permits it to be installed in a relatively thin shoe outsole. In the embodiment illustrated in FIGS. 1-11 the receptacle axial profile is approximately 4.0 mm. In the embodiment illustrated in FIGS. 12-17 the receptacle vertical profile can be made as small as 3.0 mm, a feature made possible by reorienting the locking structure ridges and locking cluster teeth to project vertically (i.e., axially) rather than horizontally (i.e., laterally). In referring to FIGS. 12-17 it should be noted that, for purposes of simplification, the typical underside of the cleat, which includes the traction elements, is not shown, and that any traction elements can be used. Cleat 110 includes a base 111 having a top surface 112 from which a stem 120 projects upward. Attachment flanges 123*a* and 123*b* extend radially outward from the distal end of the stem. These elements are all similar to the corresponding elements of cleat 10 described above. Likewise, receptacle 150 has boss 154 containing a hollow cavity 155 and a distal end wall 156 with a contoured aperture 157 to receive the cleat stem and attachment flanges. These elements are also similar to corresponding elements in receptacle 50. In this embodiment the cleat has four locking structures 130*a*, 130*b*, 130*c*, 130*d* that are substantially identical and positioned in angularly spaced relation in an annular array spaced radially outward from stem 120. It is to be understood that four locking structures are only one example, and that any number of one or more such structures may be provided. Likewise, any number of one or more attachment flanges may be provided. In the illustrated embodiment the flanges 123*a* and 123*b* extend in opposite directions with their angular centers 180° apart and their distal ends extending a radial distance that is smaller than the radial distance of the innermost parts of the locking structures. The angular center of locking structure 130*b* is spaced 60° clockwise from the angular center of flange 123*b* and 60° counterclockwise from the angular center of locking structure 130*c* which is spaced 60° counterclockwise from the angular center of flange 123*a*. The angular center of locking structure 130*d* is spaced 60° clockwise from the angular center of flange 123*a* and 60° counterclockwise from the angular center of locking structure 130*c* which is spaced 60° counterclockwise from the angular center of flange 123*b*.

Each locking structure 130*a*, 130*b*, 130*c*, 130*d* includes three angularly spaced ridges 141, 142, 143 projecting longitudinally and interleaved with annularly successive recesses 144, 145. Each ridge includes an upstanding support member having a distal end that tapers upwardly to form a radially extending substantially lineal edge which can be rounded, if desired. In the illustrated embodiment the upstanding support members are of rectangular lateral cross-section which is not a limiting feature of the invention. The height of ridges is preferably such that the distal edge is at a lower lateral level than the undersurface of the flanges. Additional requirements for the positioning and configuration of the ridges are described below.

Receptacle 150 is provided with a continuous annular array of alternating radially extending teeth 174 and recesses 171. The array is radially positioned to be aligned with ridges 141 when stem 120 and flanges 123*a*, 123*b* are inserted through aperture 157 into cavity 155. The ridges are configured to be received in recesses 171 and are sufficiently resiliently flexible to bend and pass over teeth 174 to successive recesses 171 in a ratcheting type engagement as stem 120 is rotated in the cavity. Rotation stop members are provided in the cavity, similar to stop members 65 in receptacle 50, to limit the rotation of the flanges and define the final angular orientation of the cleat and receptacle. Additional stop members may be provided in angular positional synchronization with the in-cavity stop members in a various functional forms. For example, one or more teeth 174 in the receptacle may be longer than the others to prevent rotation of a ridge past that tooth.

Upon full axial insertion of stem 120 and flanges 123*a*, 123*b* into cavity 155, the ridges and teeth on the locking structures and clusters are fully engaged throughout their radial lengths. During cleat rotation, as each ridge passes a respective tooth into an adjacent recess, the installer us able to audibly and tactilely sense a "click".

The underside of the flanges and the interior surface of the boss end wall are preferably tapered to provide a friction fit as described in connection with cleat 10 and receptacle 50. Likewise, friction fit mating ramps may provide an angled interface on the exposed outer surface of end wall 156 and the top surface of the cleat between stem 120 and the locking structures 130*a*, 130*b*, 139*c* 130*d*.

Figure 18:
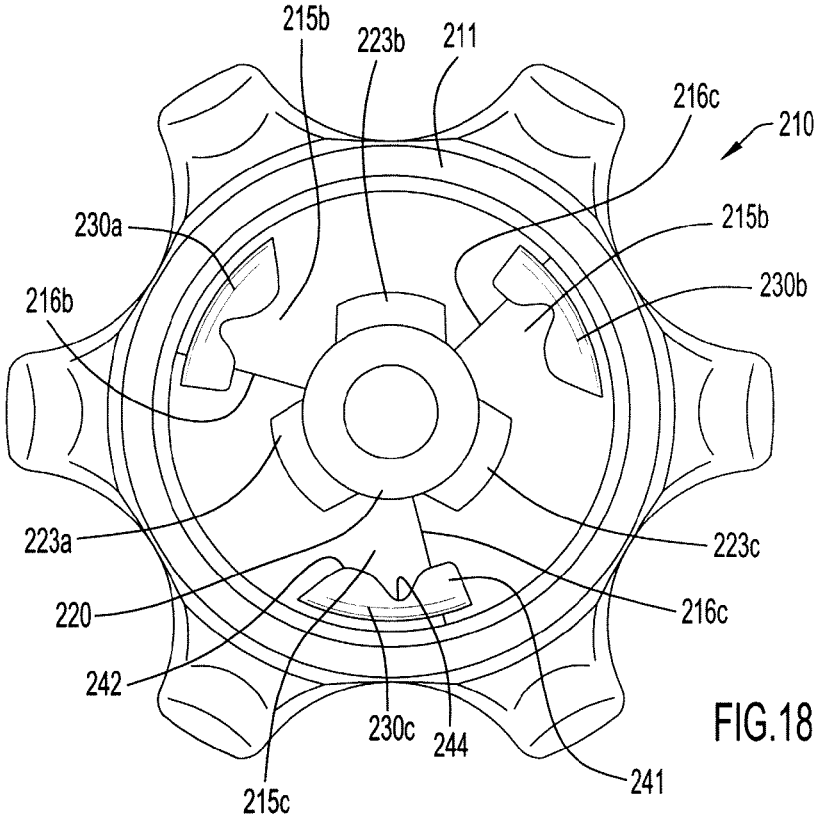
FIG. 18 is a top view in plan of a cleat according to a third embodiment of the present invention.
Figure 19:
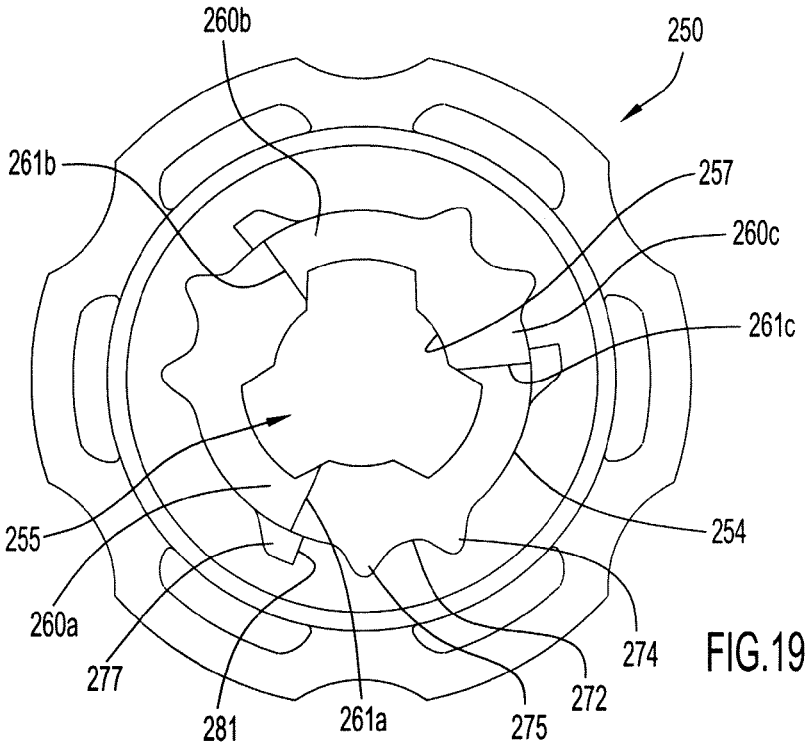
FIG. 19 is a bottom view in plan of a receptacle according to the third embodiment of the invention for receiving the cleat of FIG. 18.

The embodiments described above include two substantially identically configured attachment flanges disposed symmetrically about cleat axis A. It is to be understood that the principles of the invention permit any differently configured flanges to be provided in the same cleat, as well as any number of flanges (one or more), and to have the flanges positioned either symmetrically or asymmetrically in relation to the cleat stem. For example, FIGS. 18 and 19 illustrate an embodiment wherein three attachment flanges are provided. Specifically, cleat 210 includes a hub 211 with a stem 220 projecting upwardly therefrom. Three attachment flanges 223*a*, 223*b*, 223*c* project radially outward from the distal end of the stem and are at successive 60° locations. Three locking structures 230*a*, 230*b*, 230*c* are disposed at respective angular locations intermediate the attachment flanges at a radial spacing from stem 220 that is greater than the radial spacing between the stem and the distal ends of the attachment flanges. The undersurface of each flange slopes such that the flanges taper in thickness angularly in the same manner as flanges 23*a*, 23*b*. In this embodiment each cleat locking structure has two ridges 241, 242 spaced by a recess 244. The leading end 236 of the structure, which is the leading edge of ridge 241, is configured as a flat planar surface extending radially and longitudinally to serve as an angular stop in the manner described for end 36 in cleat 10. Three 120°-spaced ramp segments 215*a*, 215*b*, 215*c* are located between respective locking structures and stem 220 and terminate in raised shoulder stops 216*a*, 216*b* 216*c* respectively.

Receptacle 250 includes a base having bottom and top surfaces and an outer ring portion with plurality of sole-mounting slots defined therethrough. A generally cylindrical boss 254 confines a hollow generally cylindrical interior or cavity 255 disposed concentrically about the receptacle longitudinal axis. The distal end wall of the boss has a contoured aperture 257 defined therethrough to receive the distal end of cleat stem 20 and its three attachment flanges 223*a*, 223*b*, 223*c*. Three shoulder stops, spaced by 60° may extend radially inward from the cavity periphery, and longitudinally across the depth of the cavity, to serve as rotational stops for the received flanges during cleat installation. The shoulder stops limit the rotation of respective attachment flanges in the cavity to approximately 60° during installation of the cleat in the receptacle.

The interior (i.e., upward-facing) surface of each of the three arcuate sections of the boss distal end wall 256, angularly located between flange-receiving sections of aperture 257, slopes upwardly in the direction of forward rotation of the flanges during installation. The result is an angular narrowing of the longitudinal depth of the cavity 255 in the installation rotation direction. This narrowing substantially matches the divergence of the undersurface on the attachment flanges to provide for a gradually increasing compression of the flange between the boss end walls as a function of the installation rotation angle. The result is an interference or friction fit that acts in concert with other locking features described herein to prevent inadvertent rotation of the installed cleat.

The exposed (i.e., downwardly-facing) surface of the boss end wall 256 may have three shallow depending helical in an angled interface with segments 260*a*, 260*b*, 260*c* successively spaced by 120° and disposed coaxially about the receptacle axis. The longitudinal height of these ramp segments increases as a function of angular displacement about the axis in the direction of cleat insertion rotation, and each ramp segment extends approximately 60° about the axis. The depending terminal edges of the boss ramp define radially extending shoulders or stops 261*a*, 261*b*, 261*c*. The boss ramp segments are positioned to be radially aligned with respective ramp segments 215*a*, 215*b*, 215*c* on cleat 210 during cleat insertion and function therewith in the manner described in connection with ramp segments 15*a*, 15*b*, 15*c* on cleat 10 and 60*a*, 60*b*, 60*c* on receptacle 50.

The outer wall of the boss is provided with three clusters of locking teeth and recesses of the type described in connection with receptacle 50 but configured and positioned to match and engage the ridges and recesses in the three locking structures 230*a*, 230*b*, 230*c*.

In general, installation of cleat 210 in receptacle 250 proceeds in the same manner described for cleat 10 and receptacle 50 except that there are three flange attachments instead of two, three locking structure/cluster engagements instead of two and three frictional fit engagements resulting from abutting ramp segments instead of two.

Figure 20:
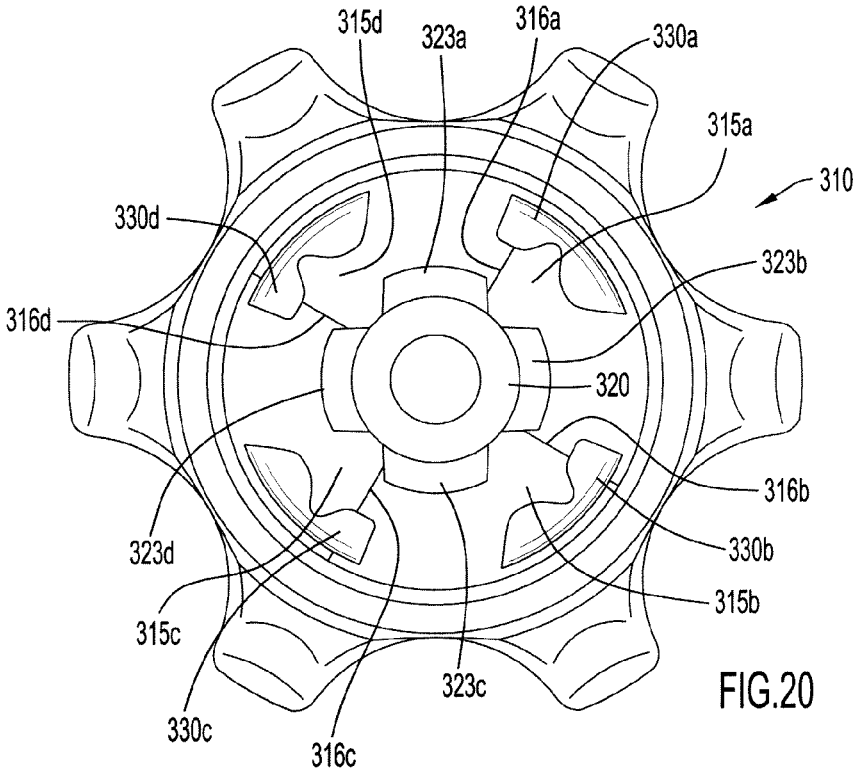
FIG. 20 is a top view in plan of a cleat according to a fourth embodiment of the present invention.
Figure 21:
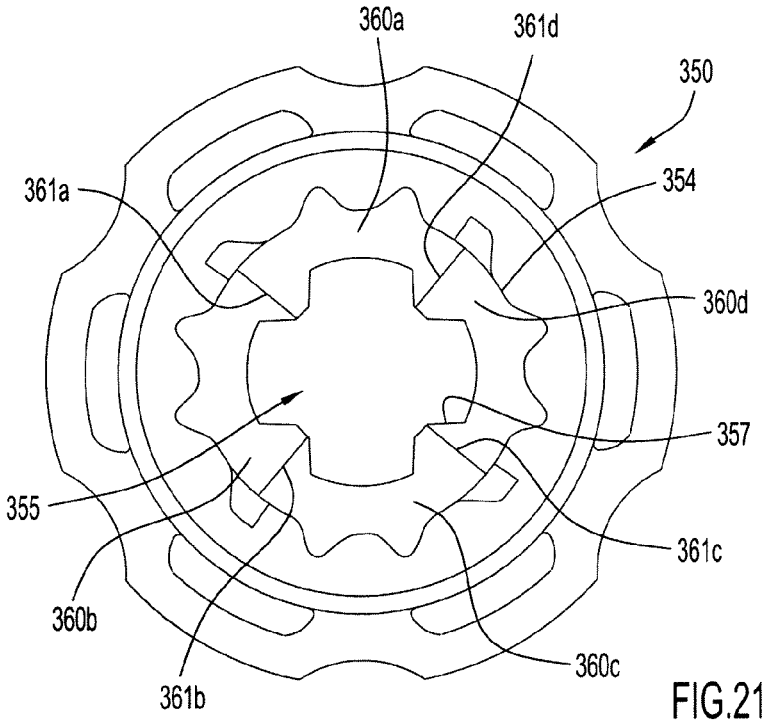
FIG. 21 is a bottom view in plan of a receptacle according to the fourth embodiment of the invention for receiving the cleat of FIG. 20.

As a further example, FIGS. 20 and 21 show a cleat 310 and receptacle 350, respectively. In cleat 310 four attachment flanges 323*a*, 323*b*, 323*c*, 323*d* and four cleat locking structures 330*a*, 330*b*, 330*c*, 330*d* are provided. In addition there are four ramp segments 315*a*, 315*b*, 315*c*, 315*d* having angular stops 316*a*, 316*b*, 316*c*, 316*d* at their ends. These elements are configured and function similarly to their counterpart elements in cleat 10. In receptacle 350 the end wall of the boss 354 has an aperture 357 configured to receive the four flanges 323*a*, 323*b*, 323*c*, 323*d* in cavity 355, four clusters of locking teeth and recesses arranged to engage respective locking structured 330*a*, 330*b*, 330*c*, 330*d* and four ramp segments 360*a*, 360*b*, 360*c*, 360*d* and stops at their raised end positioned and arranged to cooperate in an angled interface with ramps 315*a*, 315*b*, 315*c*, 315*d* and angular stops 316*a*, 316*b*, 316*c*, 316*d* in the manner described in connection with cleat 10 and receptacle 50.

Figure 22:
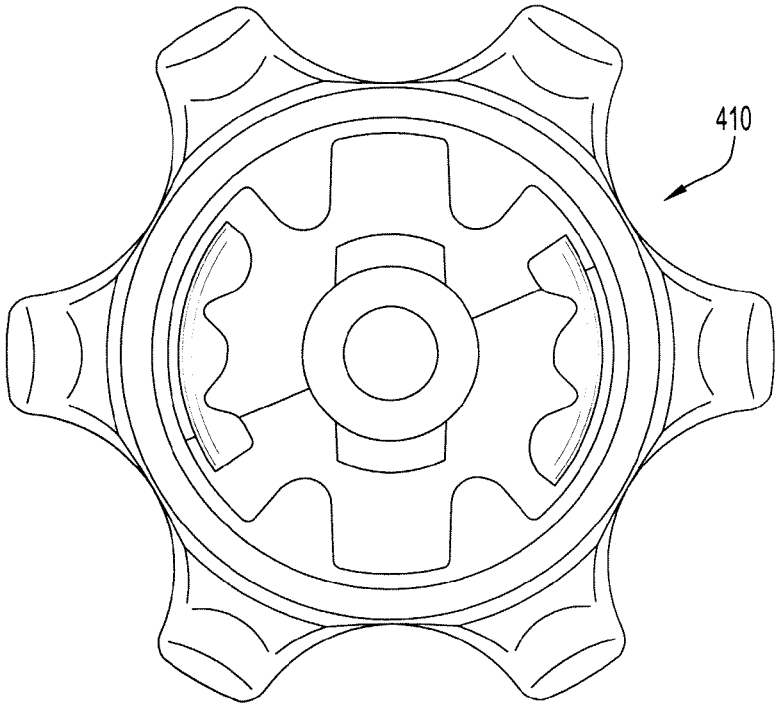
FIG. 22 is a top view in plan of a cleat according to a fifth embodiment of the present invention.
Figure 23:
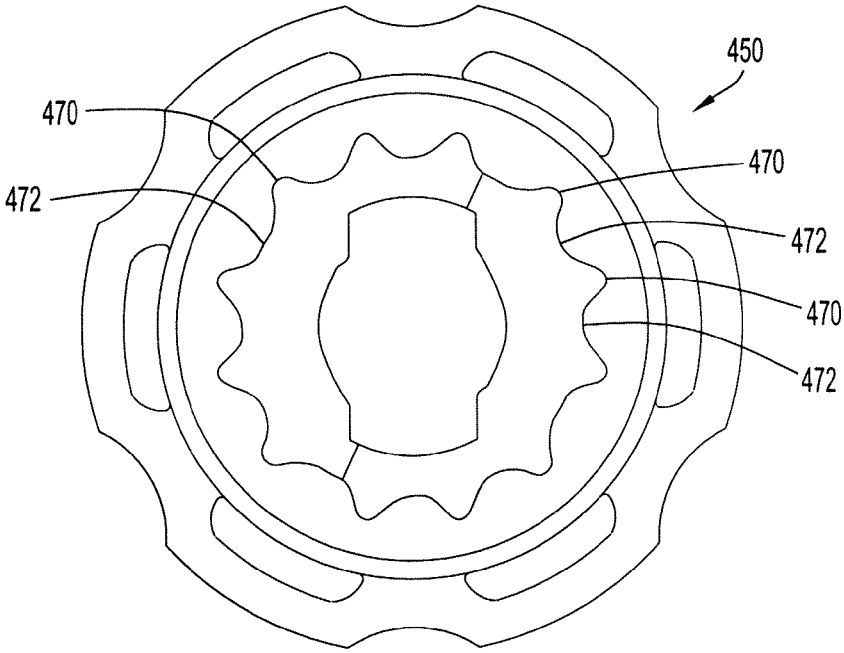
FIG. 23 is a bottom view in plan of a receptacle according to the fifth embodiment of the invention for receiving the cleat of FIG. 22.

Referring to FIGS. 22 and 23, the cleat 410 is essentially the same as cleat 10 and is arranged to be received in receptacle 450 which is similar to receptacle 50. However, instead of there being two angularly separated clusters of locking teeth and recesses on the outer wall of the receptacle boss there is one continuous cluster of successive locking teeth 470 and recesses 472 extending around the entire boss circumference. Upon axial insertion of the stem into the cavity, the receptacle locking teeth and cleat locking ridges are immediately interleaved although stem and flanges can still be axially withdrawn from the cavity. Upon rotation of the stem the flange becomes axially trapped in the cavity by the boss end wall and becomes frictionally engaged in the manner described as in receptacle 50.

Figure 24:
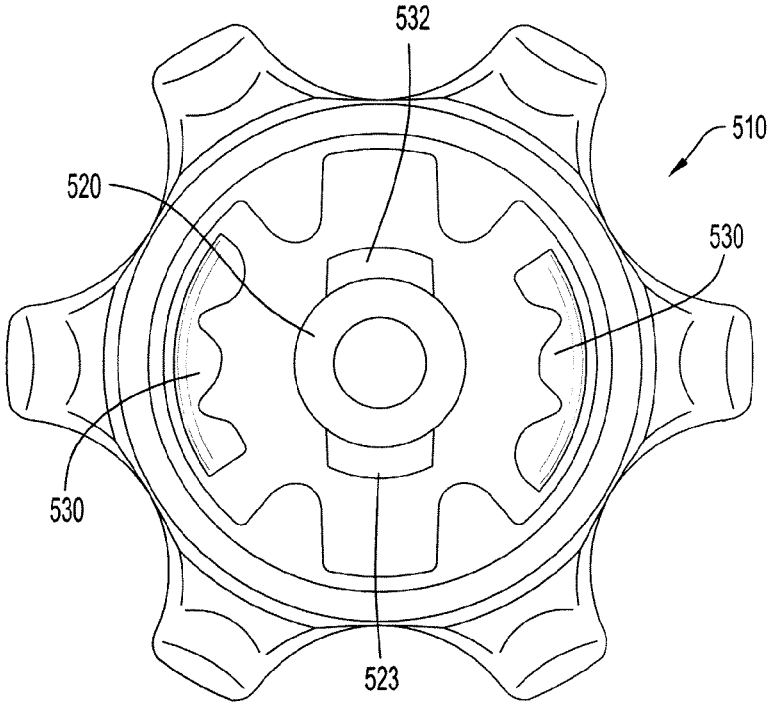
FIG. 24 is a top view in plan of a cleat according to a sixth embodiment of the present invention.
Figure 25:
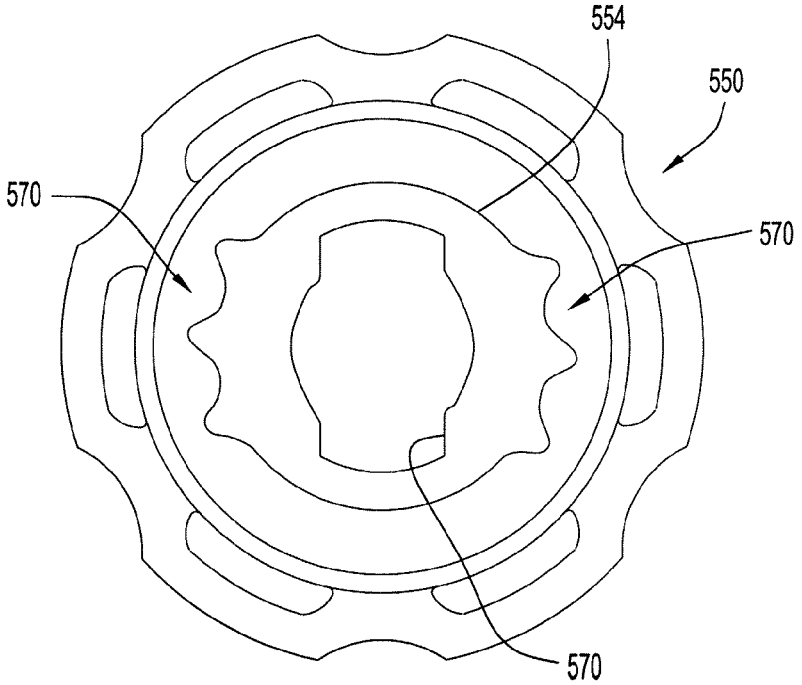
FIG. 25 is a bottom view in plan of a receptacle according to the sixth embodiment of the invention for receiving the cleat of FIG. 24.

Referring to FIGS. 24 and 25, the cleat 510 is essentially the same as cleat 10 and is arranged to be received in receptacle 550 which is similar to receptacle 50. However, instead of the two receptacle locking clusters 570 being angularly centered co-linearly with the angular center of the flange receiving portions of aperture 557, locking clusters 570 on boss 554 are offset by 90°. In this embodiment, instead of the stem having to be rotated for there to be engagement between the cleat locking structures 530 and the receptacle locking clusters 570, the locking structures and locking clusters are immediately engaged. In this position the stem 520 and flanges 523 can still be withdrawn from the receptacle cavity. As the stem and flanges are rotated in the cavity, the cleat locking structures 530 rotate past respective receptacle locking clusters until, after approximately 90° of rotation, cleat locking structures 530 and receptacle locking clusters 570 are no longer in angular alignment. Instead the cleat locking structures reside in annular gaps between the receptacle locking clusters and are free to rotationally move within those gaps. This provides for angular "play" or swivel for the cleat in the receptacle, typically on the order of ±15°. This feature provides a rotational traction cushioning effect wherein, depending on the movement of the shoe sole relative to the ground surface, traction may become effective gradually.

Figure 26:
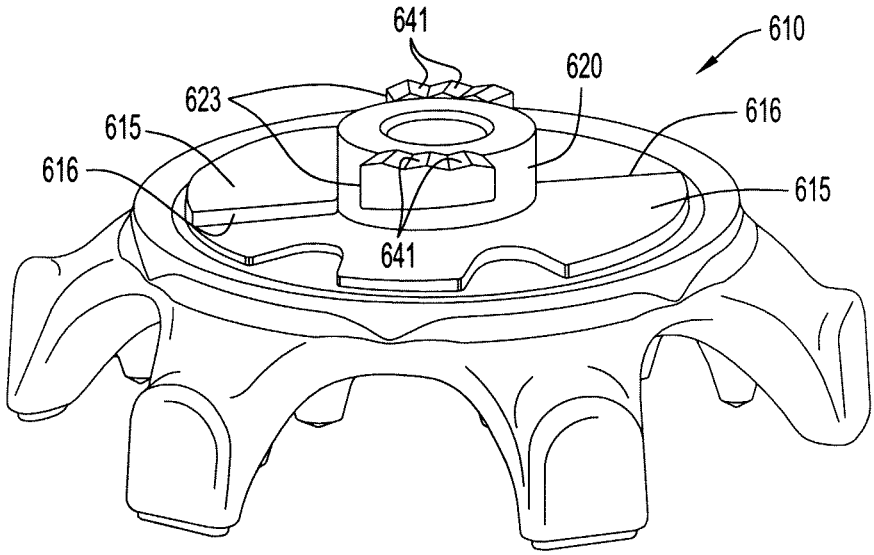
FIG. 26 is a view in perspective from above of a cleat according to a seventh embodiment of the present invention.
Figure 27:
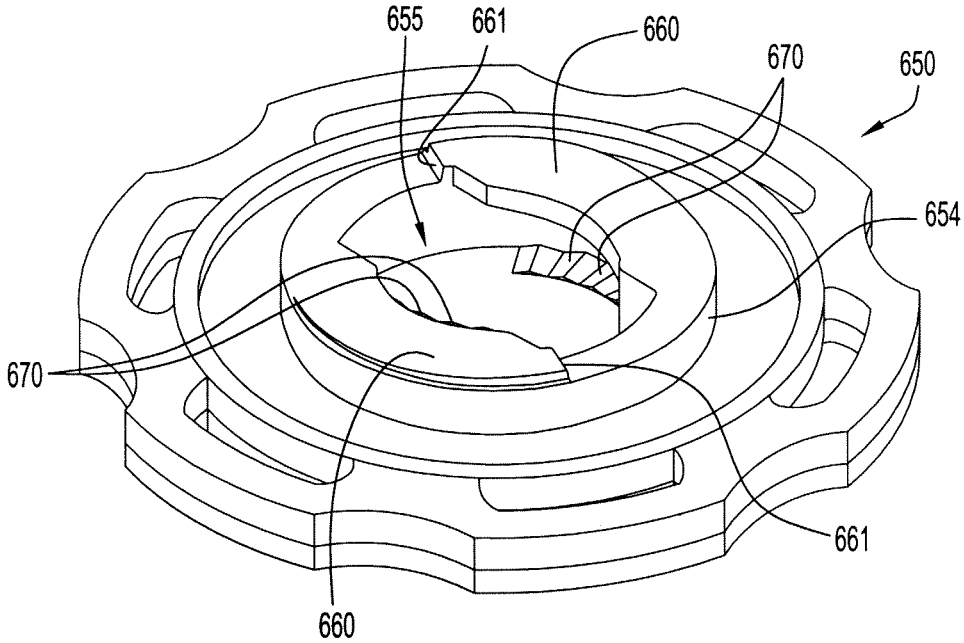
FIG. 27 is a view in perspective from below of a receptacle according to the seventh embodiment of the invention for receiving the cleat of FIG. 26.

In the embodiments described above the cleat locking ridges and receptacle locking teeth are located outside the receptacle cavity, a feature which has many advantages. However, in some instances it may be desirable to provide these locking structures inside the receptacle cavity. Referring to FIGS. 26 and 27, a cleat 610 is provided with a stem 620 from the distal end of which two attachment flanges 623 project radially outward as in cleat 10. Each attachment flange 623 has a series of side-by-side locking ridges 641 projecting upwardly from the top surface of the flange and extending radially outward from the stem. The upper end of the ridges is preferably linear but it can be curved or chamfered. The cleat hub is provided with two helical ramped segments 615 terminating in raised angular stops 616 surrounding stem 620. Cleat 610 is similar to cleat 10 but, importantly, has no locking structures on its hub.

Receptacle 650 is adapted to receive cleat 610 in its cavity 655 contained in a boss 654. The exposed surface of the boss end wall is provided with two ramped segments 660 to engage ramped segments 615 of the cleat in an angled interface as described for cleat 10 and receptacle 50. The raised edge 661 at the terminus of each ramp cooperates with a respective angular stop 616 on the cleat to limit insertion rotation to the final angular orientation of the cleat. Boss 654 has no locking teeth; instead, locking teeth 670 are provided on the interior surface of the bottom wall of cavity 655 and are positioned to engage locking ridges 641 on flanges 623 when the flanges are rotated in the cavity to a locking position. The ridges 641 and teeth 670 engage in a washboard type of relation to prevent inadvertent rotation of the cleat from its final angular orientation.

It will be appreciated that the ridges and teeth shown in FIGS. 26, 27 may alternatively, or in addition, be provided on the bottom surface of the attachment flanges 623 and undersurface of the distal end wall of boss 654. The locking need not be limited to regular ridge and tooth structures but can be provided by irregular surface configurations on the inside surface of either end wall of the cavity and on either the top or bottom surfaces of the flange. As a further alternative surface irregularities such as bumps may be provided on the top surface of the cleat between the stem and locking structures an angular position to permit the irregularities to project into the cavity at the flange receiving opening in aperture 57 when the cleat is rotated to its final angular orientation.

Figure 28:
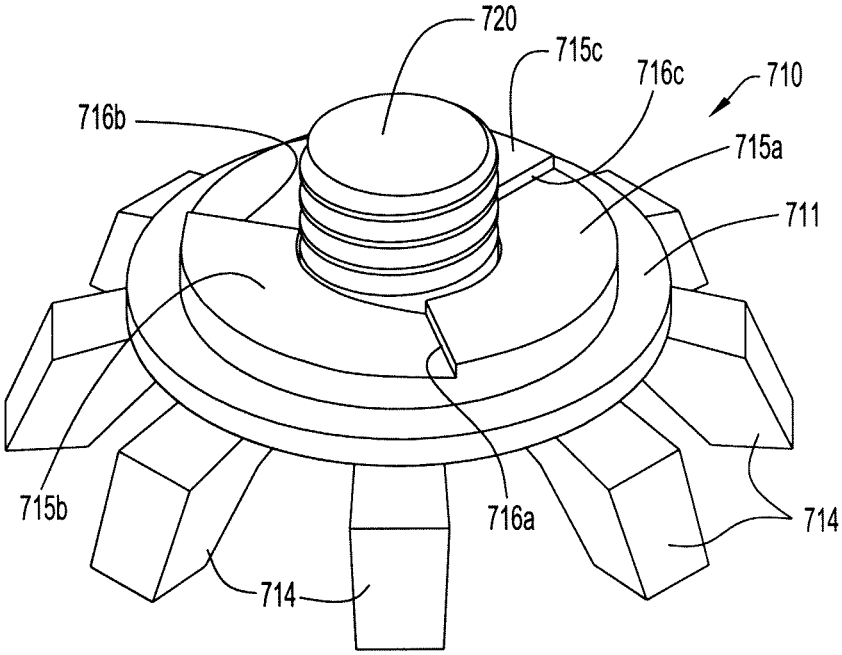
FIG. 28 is a view in perspective from above of a cleat according to an eighth embodiment of the present invention.
Figure 30B:
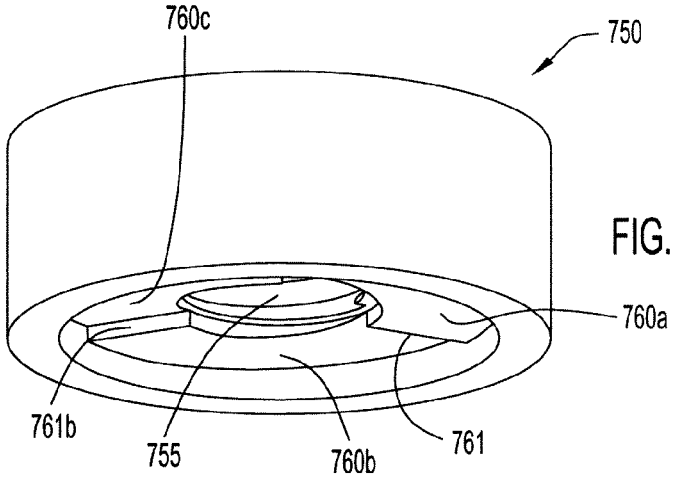
FIG. 30B is a view in perspective from below of the receptacle of FIG. 30A.
Figure 30A:
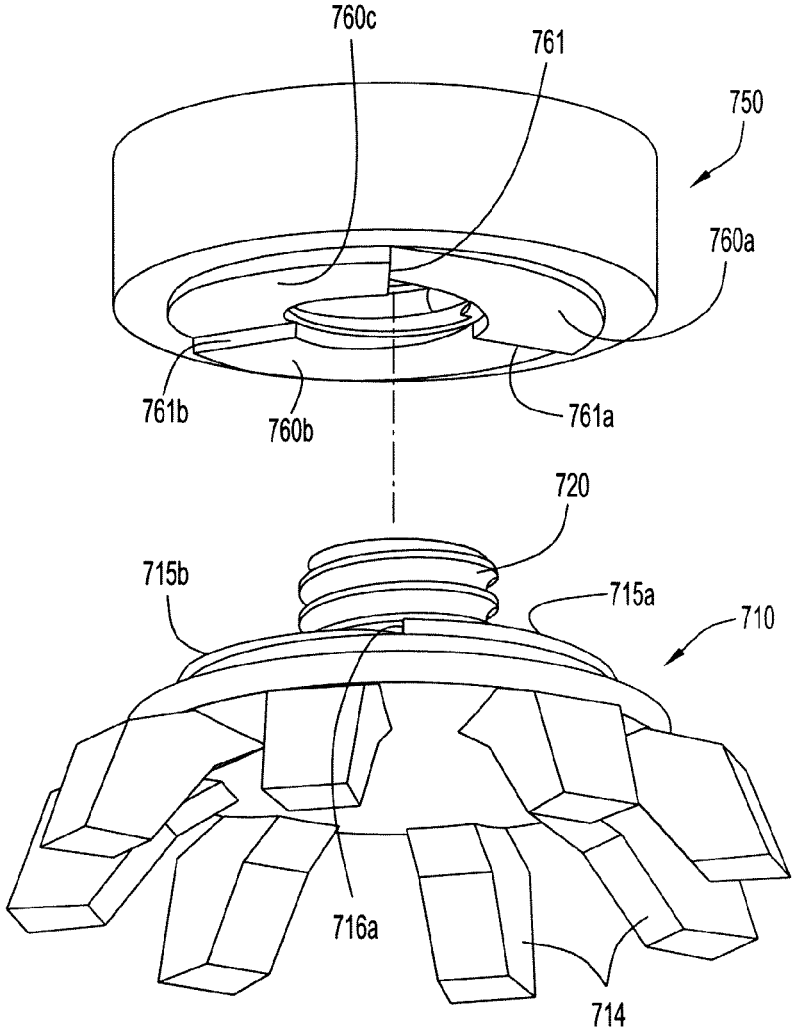
FIG. 30A is an exploded view in perspective from below showing the cleat of FIG. 28 in combination with a receptacle for receiving that cleat.

The angled interface provided between ramped segments 15*a*, 15*b* on the cleat hub ramped segments 60*a*, 60*b* on the receptacle boss need not be limited to a flange-in-cavity type of attachment. Referring to FIGS. 28, 30A and 30B, a cleat 710 is illustrated with a conventional threaded stem 720 projecting upwardly from the cleat hub 711. Conventional traction elements extend downwardly from the cleat bottom. The top surface of the cleat is angularly subdivided into a plurality (in this case three) of shallow upwardly extending helical ramp segments 715*a*, 715*b*, 715*c* in angular sequence and disposed coaxially about the cleat axis A. The height of the ramp segments increases as a function of angular displacement about the cleat axis in the direction of cleat insertion rotation, and each ramp segment extends angularly approximately 120°. The raised terminal edges of the ramp segments 715*a*, 715*b*, 715*c*, respectively, define radially extending shoulders or stops 716*a*, 716*b*, 716*c*. These stops are positioned to abut corresponding rotational stop structure on the receptacle, described below, in the final angular insertion position of the cleat.

The downward facing surface of receptacle 750 is subdivided into three shallow depending helical ramp segments 760*a*, 760*b*, 760*c* disposed coaxially about the receptacle axis. The longitudinal height of ramp segments 760*a*, 760*b*, 760*c* increases as a function of angular displacement about the axis in the direction of cleat insertion rotation, and each ramp segment extends approximately 120° about the axis. The depending terminal edges of these ramp segments define respective radially extending shoulders or stops 761*a*, 761*b*, 761*c*. Ramp segments 760*a*, 760*b*, 760*c* are positioned to be radially aligned with ramp segments 715*a*, 715*b*, 715*c*, respectively, of cleat 710 in an angled interface during cleat insertion. In particular, upon rotational insertion of threaded stem 720 in threaded socket 755 the abutting ramp segments are forced into tighter axial engagement that increases with rotation angle until shoulder stops 716*a*, 716*b*, 716*c* abut respective shoulder stops 761*b*, 761*a* 761*c*. This occurs when the cleat has reached its final angular orientation relative to the receptacle and the frictional engagement between abutting ramp segments is at a maximum.

Figure 29:
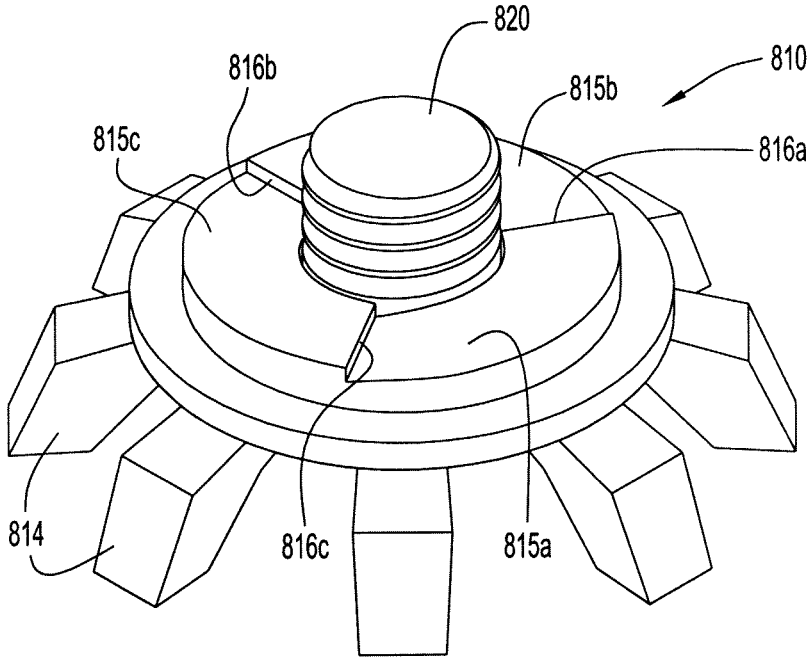
FIG. 29 is a view in perspective from above of a cleat according to a ninth embodiment of the present invention.

It is of interest to note that the ramp segments on the cleat may be inclined in the opposite angular direction with a different result. For example, in cleat 710 the ramped segments 715*a*, 715*b*, 715*c* increase in height in a counterclockwise direction. In cleat 810, illustrated in FIG. 29, the ramped segments 815*a*, 815*b*, 815*c* increase in height in a clockwise direction. When cleat 810 is rotationally inserted into receptacle 750, the ramped segments 815*a*, 815*b*, 815*c* of cleat 810 abut and ride along corresponding ramped segments 761*a*, 761*b*, 761*c* of the receptacle, with gradually tightening engagement, until the cleat ramp termini 816*a*, 816*b*, 816*c* move over the receptacle ramp termini 716*a*, 716*b*, 716*c* to permit the termini to snap longitudinally toward one another and then into angularly abutting relation to define the final angular orientation of the cleat sand receptacle.

Figure 31:
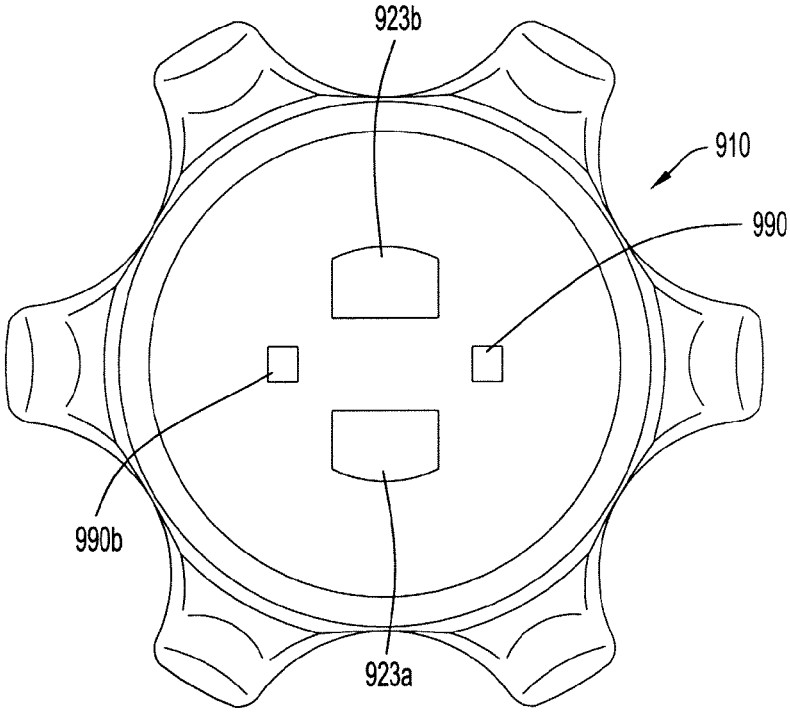
FIG. 31 is a top view in plan of a cleat according to a tenth embodiment of the present invention.
Figure 32:
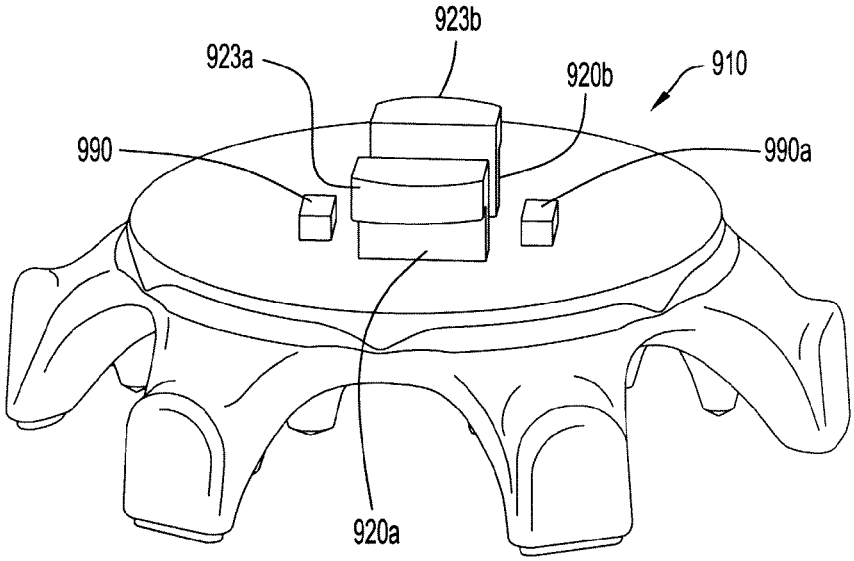
FIG. 32 is a view in perspective from above of the cleat of FIG. 31.

The flange-bearing stem 20 need not be a single member. Specifically, as disclosed in U.S. Pat. No. 6,631,571 (McMullin), each attachment flange may be supported by its own stem which can be resiliently pivotally flexed slightly to permit small relative displacement between the supported flanges to assist during flange insertion into and removal from cavity 55 through aperture 57 and to more readily absorb laterally directed impact forces applied to the cleat without disengaging the locking structures. An example of such an arrangement is illustrated in FIGS. 31, 32 wherein cleat 900 includes two stems 920*a*, 920*b* disposed in spaced relation on opposite sides of the cleat attachment axis. In the illustrated embodiment these stems are spaced 180° apart in symmetrical relation about the axis in order to be used with receptacle of FIG. 6. It should be appreciated that the stems can be asymmetrically positioned and that any number of stems may be provided, depending on the configuration of the receptacle with which it is used. The proximal ends of stems 920*a*, 920*b* are disposed at the top surface of the cleat hub. Respective attachment flanges 923*a*, 923*b* extend radially outward in 180° spaced relation from the distal ends of stems 920*a*, 920*b*. These flanges, although possibly shorter in radial length than flanges 23*a*, 23*b* (FIG. 1) because the spacing between the two stem, are positioned and configured to be received in the flange-receiving portions on aperture 57 (FIG. 1) and function therein in the same manner as flanges 23*a*, 23*b*. Two stop blocks 990*a*, 990*b*, spaced by 180°, project upwardly from the cleat hub at angular locations spaced 90° from stems 920*a*, 920*b*. The radial positions and lateral cross-sectional configurations of the stop blocks permit them to be aligned with and closely fit into respective flange-receiving portions of aperture 57 of receptacle 50 (FIG. 1) in the final or locked angular orientation of the cleat and receptacle. As the cleat is rotated the sloped undersurfaces of the flanges become more tightly engaged with the sloped interior surface of the cavity end wall, and the distal ends of stop blocks 990*a*, 990*b* are pulled gradually closer to the distal end wall 56 of receptacle boss 54 (FIG. 1) as the blocks are rotated along with stems the cleat. When the blocks reach the flange-receiving portions of aperture, which corresponds to the final or locking angular orientation of the cleat, the blocks are pulled up in a snap-like manner into respective aperture portions so that the blocks extend into the cavity. When so positioned the stop blocks serve to strongly resist inadvertent rotation and removal of the cleat from its locked position. In order to facilitate replacement of the cleat by a suitable wrench or tool as described above, the stop blocks may be constructed of resiliently flexible material to permit them to be bent sufficiently to become dislodged from aperture 57 in response to a sufficient torque applied to the cleat. Alternatively, or in addition, the side wall of the block facing the removal rotation direction may be sloped or otherwise contoured to permit removal from aperture 57 in response to the applied torque but as a result of normal use of the cleat.

Persons skilled in the art will understand that the use of two attachment stems is not a limiting feature of the invention and that three or more stems may be provided to be received in the receptacles of FIGS. 19 and 21, for example. Likewise, the number of stop blocks can be increased to accommodate a particular receptacle.

It must also be noted that plural stem embodiments are not restricted to the use of stop block locking and that the locking structures described herein and illustrated in the various drawings can readily function with plural locking stems.

It will be appreciated that the embodiments described above and illustrated in the drawings represent only a few of the many ways of implementing the principles of the present invention. For example, the stem 20 and other attachment stems described herein need not be circular in lateral cross-section; any regular or irregular polygonal cross-section may be used. The attachment flanges 23*a*, 23*b* and the others described herein can have substantially any lateral peripheral shape as long as it is consistent with the functional features described herein. Likewise, boss 54 and cavity 55, as well as the bosses and cavities in the various embodiments, need not have circular cylindrical configurations but instead can have any regular or irregular polygonal lateral cross-sectional shapes consistent with the operational principles described herein.

Surfaces and other structural features shown in the drawings with particular contours or topographies need not be so unless described as requiring same for a particular function.

As noted herein, although the invention has been disclosed with primary application for golf shoes, the principles are equally applicable for cleated shoes of other types used in other athletic activities, such as soccer, football, baseball, etc.

Having described preferred embodiments of new and improved methods and apparatus for interconnecting traction cleats and receptacles therefor, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. An attachment and locking system for a traction cleat replaceably attachable to a receptacle adapted to be installed in a shoe outsole, said system comprising:

said traction cleat including:

a hub having top and bottom surfaces and a longitudinally extending cleat attachment axis extending substantially perpendicular to said top and bottom surfaces;

at least one ground-engaging traction element projecting generally downward from said bottom surface;

at least one stem having a proximal end at the top surface of said hub and a distal end, said stem extending axially upward from said top surface substantially concentrically about the cleat attachment axis;

an attachment flange structure having a predetermined lateral periphery configuration and including at least one flange member extending generally radially from said stem proximate the distal end of said stem;

a cleat locking structure;

at least one arcuate hub ramp segment projecting gradually from the hub top surface as a function of angular location about the cleat attachment axis to provide an angled interface for contacting the receptacle, the hub ramp segment having maximally and minimally raised angularly displaced ends;

said receptacle comprising:

a base adapted to be secured in the shoe outsole and having a bottom surface and a longitudinally extending receptacle attachment axis;

a boss having a distal end and a proximal end proximate at said bottom surface, said boss extending generally longitudinally from said base and having a hollow interior cavity extending generally downward about the receptacle attachment axis;

a distal end wall on said boss having interior and exterior surfaces and a through aperture configured to permit said attachment flange structure to be passed axially through the aperture and received in said cavity with the cleat attachment axis and the receptacle attachment axis coincident and in an angular insertion orientation relative to said receptacle such that the flange structure can be angularly rotated in the cavity about the coincident axes to an angular locking orientation relative to said receptacle, said end wall being further configured to prevent axial removal of said attachment flange structure from said cavity in said angular locking orientation;

at least one arcuate receptacle ramp segment projecting gradually from the exterior surface of the boss end wall as a function of angular location about the cleat attachment axis, said receptacle ramp being positioned to be aligned with and abut the hub ramp segment in an increasing friction fit engagement as the flange structure is rotated in the cavity from said angular insertion orientation to said angular locking orientation to provide said angled interface, the hub ramp segment having maximally and minimally raised angularly displaced ends disposed at different distances from said base;

a receptacle locking structure positioned to engage said cleat locking structure in said angular locking orientation to prevent inadvertent angular rotation between said cleat and said receptacle.

2. The system of claim 1:

wherein said attachment flange structure includes at least one flange member extending radially outward from said stem and having an undersurface spaced from and facing said hub with a slope that increases the longitudinal thickness of the flange member as a function of angular location about the cleat attachment axis; and wherein the interior surface of said boss distal end wall faces and abuts the undersurface of said flange member as the flange member is rotated in said cavity toward said angular locking orientation, said interior surface having a slope that increases as a function of angular location about the receptacle attachment axis such that said undersurface of the flange member and said interior surface become more closely engaged in an increasing fit as the flange member is rotated toward said angular locking orientation.

3. The system of claim 2 wherein the maximum height of the receptacle in a dimension parallel to the receptacle attachment axis is four millimeters or less.

4. The system of claim 3 wherein the thickness of said flange member in a dimension parallel to the cleat attachment axis is 1.6 millimeters or less.

5. The system of claim 1:

wherein the cleat locking structure comprises a structure extending upward from said base in radially spaced relation from said stem and including at least two convex ridges separated by a recess facing said stem; and wherein said receptacle locking structure includes a series of locking teeth projecting radially outward from said boss, said teeth being configured and positioned to project into said recess between said ridges when angularly aligned therewith.

6. The system of claim 1:

wherein the cleat locking structure comprises a structure extending upward from said attachment flange structure in radially spaced relation from said stem and including at least two convex ridges separated by a recess facing said stem; and wherein said receptacle locking structure includes a series of locking teeth projecting downward in said cavity from the proximal end of said boss, said teeth being configured and positioned to project into said recess between said ridges when angularly aligned therewith.

7. The system of claim 1:

wherein said receptacle is arranged to lock the cleat in a predetermined angular locking orientation;

said cleat further comprising a plurality of separate cleat angular stop shoulders located at different radially spaced locations from said cleat attachment axis;

said receptacle further comprising a plurality of separate receptacle angular stop shoulders located at different radially spaced locations from said cleat attachment axis;

wherein each of said cleat stop shoulders is positioned to abut a corresponding one of said receptacle stop shoulders at said angular locking orientation to prevent further rotation of the cleat relative to the receptacle in the insertion direction.

8. The system of claim 1:

wherein said attachment flange structure includes plural flange members extending generally radially from said stem proximate the distal end of said stem at angularly spaced positions about the cleat attachment axis; and wherein said through aperture is contoured to match contours of said plural flange members and permit them to be passed axially through the aperture and received in said cavity in said angular insertion orientation such that the flange members can be angularly rotated simultaneously in the cavity about the coincident axes to said angular locking orientation relative to said receptacle.

9. The system of claim 1 further comprising a stop member disposed within said cavity for limiting rotation of the cleat relative to the receptacle from the angular insertion orientation at said predetermined angular locking orientation.

10. An attachment and locking system for a traction cleat replaceably attachable to a receptacle adapted to be installed in a shoe outsole, said system comprising:

said traction cleat including:

a hub having top and bottom surfaces and a longitudinally extending cleat attachment axis extending substantially perpendicular to said top and bottom surfaces;

at least one ground-engaging traction element projecting generally downward from said bottom surface;

at least one stem having a proximal end at the top surface of said hub and a distal end, said stem extending axially upward from said top surface substantially concentrically about the cleat attachment axis;

a flange member having a predetermined lateral periphery configuration and extending generally radially from said stem proximate the distal end of said stem, wherein the thickness of said flange member in a dimension parallel to the cleat attachment axis is 1.6 millimeters or less;

a cleat locking structure;

said receptacle comprising:

a base adapted to be secured in the shoe outsole and having a bottom surface and a longitudinally extending receptacle attachment axis;

a boss having a distal end and a proximal end proximate at said bottom surface, said boss extending generally longitudinally from said base and having a hollow interior cavity extending generally downward about the receptacle attachment axis;

a distal end wall on said boss having interior and exterior surfaces and a through aperture configured to permit said attachment flange structure to be passed axially through the aperture and received in said cavity with the cleat attachment axis and the receptacle attachment axis coincident and in an angular insertion orientation relative to said receptacle such that the flange structure can be angularly rotated in the cavity about the coincident axes to an angular locking orientation relative to said receptacle, said end wall being further configured to prevent axial removal of said attachment flange structure from said cavity in said angular locking orientation;

a receptacle locking structure positioned to engage said cleat locking structure in said angular locking orientation to prevent inadvertent angular rotation between said cleat and said receptacle; and wherein the maximum height of the receptacle in a dimension parallel to the receptacle attachment axis is four millimeters or less.

11. An attachment and locking system for a traction cleat replaceably attachable to a receptacle adapted to be installed in a shoe outsole, said system comprising:

said traction cleat including:

a hub having top and bottom surfaces and a longitudinally extending cleat attachment axis extending substantially perpendicular to said top and bottom surfaces;

at least one ground-engaging traction element projecting generally downward from said bottom surface;

a plurality of stems, each having a proximal end at the top surface of said hub and a distal end, said stems being positioned at different angular locations about the cleat attachment axis and extending axially upward from said top surface substantially generally parallel to the cleat attachment axis;

a plurality of attachment flange members having predetermined lateral peripheries and extending generally radially from the distal end of a respective stems;

a cleat locking structure;

at least one arcuate hub ramp segment projecting gradually from the hub top surface as a function of angular location about the cleat attachment axis to provide an angled interface for contacting the receptacle, the hub ramp segment having maximally and minimally raised angularly displaced ends;

said receptacle comprising:

a base adapted to be secured in the shoe outsole and having a bottom surface and a longitudinally extending receptacle attachment axis;

a boss having a distal end and a proximal end proximate at said bottom surface, said boss extending generally longitudinally from said base and having a hollow interior cavity extending generally downward about the receptacle attachment axis;

a distal end wall on said boss having interior and exterior surfaces and a through aperture configured to permit said attachment flange members to be passed axially through the aperture and received in said cavity with the cleat attachment axis and the receptacle attachment axis coincident and in an angular insertion orientation relative to said receptacle such that the flange structure can be angularly rotated in the cavity about the coincident axes to an angular locking orientation relative to said receptacle, said end wall being further configured to prevent axial removal of said attachment flange members from said cavity in said angular locking orientation;

at least one arcuate receptacle ramp segment projecting gradually from the exterior surface of the boss end wall as a function of angular location about the cleat attachment axis, said receptacle ramp being positioned to be aligned with and abut the cleat ramp segment in an increasing friction fit engagement as the flange structure is rotated in the cavity from said angular insertion orientation to said angular locking orientation to provide said angled interface, the hub ramp segment having maximally and minimally raised angularly displaced ends disposed at different distances from said base;

a receptacle locking structure positioned to engage said cleat locking structure in said angular locking orientation to prevent inadvertent angular rotation between said cleat and said receptacle.

12. The system of claim 11:

wherein each of said attachment flange members has an undersurface spaced from and facing said hub with a slope that gradually increases the longitudinal thickness of the flange member as a function of angular location about the cleat attachment axis; and wherein the interior surface of said boss distal end wall faces and abuts the undersurface of each flange member as the flange members is are rotated in said cavity toward said angular locking orientation, said interior surface having a sloped section facing each flange member that gradually rises from the interior surface as a function of angular location about the receptacle attachment axis such that said undersurfaces of the flange members and said interior surface sections become more closely engaged in an increasingly tight fit as the flange members are rotated toward said angular locking orientation.

13. The system of claim 12 wherein the maximum height of the receptacle in a dimension parallel to the receptacle attachment axis is four millimeters or less.

14. The system of claim 13 wherein the thickness of said flange member in a dimension parallel to the cleat attachment axis is 1.6 millimeters or less.

15. An attachment and locking system for a traction cleat replaceably attachable to a receptacle adapted to be installed in a shoe outsole, said system comprising:

said traction cleat including:

a hub having top and bottom surfaces and a longitudinally extending cleat attachment axis extending substantially perpendicular to said top and bottom surfaces;

at least one ground-engaging traction element projecting generally downward from said bottom surface;

a stem having extending upward from said top surface;

at least one arcuate hub ramp segment projecting gradually from the hub top surface as a function of angular location about the cleat attachment axis to provide an angled interface for contacting the receptacle, the hub ramp segment having maximally and minimally raised angularly displaced ends disposed at different distances from said hub to surface;

said receptacle comprising:

a base adapted to be secured in a shoe sole and having a bottom surface and a longitudinally extending receptacle attachment axis;

a cavity for receiving and attaching to said stem; and a downward facing wall on said receptacle surrounding said cavity having at least one arcuate receptacle ramp segment projecting gradually downward as a function of angular location about the cleat attachment axis, said receptacle ramp being positioned to be aligned with and abut the hub ramp segment in an increasing friction fit engagement as the stem is rotated in the cavity in an insertion direction to provide an angled interface.

16. The system of claim 1 wherein the receptacle is a molded plastic unit having a hardness greater than the hardness of the attachment flange structure.

17. The system of claim 16 further comprising a shoe of which the outsole is a part, wherein said shoe outsole is a moldable material, wherein said base further includes a plurality of mounting slots defined therethrough, and wherein said receptacle is secured and embedded in said outsole by said outsole moldable material formed around the mounting slots.

18. The system of claim 16 wherein the durometer hardness of the receptacle is in the range of 88 D-93 D, and the durometer hardness of the attachment flange structure is in the range of 55 D-75 D.

19. The system of claim 15 wherein the durometer hardness of the receptacle is in the range of 88 D-93 D, and the durometer hardness of the attachment flange structure is in the range of 55 D-75 D.

20. An attachment and locking system for a traction cleat replaceably attachable to a receptacle adapted to be installed in a shoe outsole, said system comprising:

said traction cleat including:

a hub having top and bottom surfaces and a longitudinally extending cleat attachment axis extending substantially perpendicular to said top and bottom surfaces;

at least one ground-engaging traction element projecting generally downward from said bottom surface;

at least one stem having a proximal end at the top surface of said hub and a distal end, said stem extending axially upward from said top surface substantially concentrically about the cleat attachment axis;

an attachment flange structure having a predetermined lateral periphery configuration and including first and second flange diametrically opposed members extending generally radially from said stem proximate the distal end of said stem;

a cleat locking structure;

at least one arcuate hub ramp segment projecting gradually from the hub top surface as a function of angular location about the cleat attachment axis to provide an angled interface for contacting the receptacle, the hub ramp segment having maximally and minimally raised angularly displaced ends;

said receptacle comprising:

a base adapted to be secured in the shoe outsole and having a bottom surface and a longitudinally extending receptacle attachment axis;

a boss having a distal end and a proximal end proximate said bottom surface, said boss extending generally longitudinally from said base and having a hollow interior cavity extending generally downward about the receptacle attachment axis;

a distal end wall on said boss having an interior surface facing generally axially and interiorly of said cavity, an exterior surface facing generally axially and exteriorly of said cavity and a through aperture configured to permit an attachment flange structure of a cleat to be passed axially through the aperture and be received in said cavity in an angular insertion orientation relative to said receptacle and such that the flange structure can be angularly rotated in the cavity about the receptacle attachment axis to an angular locking orientation relative to said receptacle, said end wall being further configured to prevent axial removal of said attachment flange structure from said cavity in said angular locking orientation;

wherein said through aperture is axially centered about said receptacle attachment axis and comprises:

first and second diametrically opposed arcuate sections located at a first radial distance from said receptacle attachment axis, and;

first and second diametrically opposed flange-receiving sections disposed angularly between said arcuate sections and extending a second radial distance from said receptacle attachment axis greater than said first radial distance;

wherein the maximum height of the receptacle in the dimension parallel to the receptacle attachment axis is five millimeters or less; and wherein the thickness of said cleat flange member in a dimension parallel to the cleat attachment axis is 1.6 millimeters or less.

21. An attachment and locking system for a traction cleat replaceably attachable to a receptacle adapted to be installed in a shoe outsole, said system comprising:

said traction cleat including:

a hub having top and bottom surfaces and a longitudinally extending cleat attachment axis extending substantially perpendicular to said top and bottom surfaces;

at least one ground-engaging traction element projecting generally downward from said bottom surface;

at least one stem having a proximal end at the top surface of said hub and a distal end, said stem extending axially upward from said top surface substantially concentrically about the cleat attachment axis;

an attachment flange structure having a predetermined lateral periphery configuration and including at least one flange member extending generally radially from said stem proximate the distal end of said stem;

a cleat locking structure;

at least one arcuate hub ramp segment projecting gradually from the hub top surface as a function of angular location about the cleat attachment axis to provide an angled interface for contacting the receptacle, the hub ramp segment having maximally and minimally raised angularly displaced ends;

said receptacle comprising:

a base adapted to be secured in the shoe outsole and having a bottom surface and a longitudinally extending receptacle attachment axis;

a boss having a distal end and a proximal end proximate said bottom surface, said boss extending generally longitudinally from said base and having a hollow interior cavity extending generally downward about the receptacle attachment axis;

a distal end wall on said boss having an interior surface facing generally axially and interiorly of said cavity, an exterior surface facing generally axially and exteriorly of said cavity and a through aperture configured with an axially centered portion from which plural radially extending flange-receiving sections project to permit an attachment flange structure of a cleat to be passed axially through the aperture and be received in said cavity in an angular insertion orientation relative to said receptacle and such that the flange structure can be angularly rotated in the cavity about the receptacle attachment axis to a angular locking orientation relative to said receptacle, said end wall being further configured to prevent axial removal of said attachment flange structure from said cavity in said angular locking orientation;

wherein said interior surface of said end wall has at least one arcuate interior ramp segment projecting gradually from the interior surface toward said proximal end of said cavity as a function of angular location about the receptacle attachment axis to vary the longitudinal depth of at least a portion of said cavity as a function of angular position about the receptacle attachment axis;

an angularly extending series of locking teeth centered about the receptacle attachment axis for cooperating with the cleat locking structure;

wherein said boss has a peripheral wall having a radially outward facing surface, and wherein said angularly extending series of locking teeth project radially outward from said peripheral wall; and wherein said series of locking teeth is arranged in plural angularly extending and angularly spaced clusters, each cluster including a plurality of locking teeth.

22. The system of claim 21 further comprising a stop member disposed within said cavity for limiting rotation of the cleat relative to the receptacle from the angular insertion orientation at said predetermined angular locking orientation.

23. The system of claim 21 further comprising at least one arcuate receptacle ramp segment projecting gradually from the exterior surface of the boss end wall as a function of angular location about the cleat attachment axis, said receptacle ramp being positioned to be aligned with and abut the hub ramp segment in an increasing friction fit engagement as the flange structure is rotated in the cavity from said angular insertion orientation to said angular locking orientation to provide said angled interface, the hub ramp segment having maximally and minimally raised angularly displaced ends disposed at different distances from said base.

* * * * *